US009631832B2

(12) United States Patent
Malott

(10) Patent No.: US 9,631,832 B2
(45) Date of Patent: Apr. 25, 2017

(54) AIR DISTRIBUTION APPARATUS

(71) Applicant: Dometic Corporation, Elkhart, IN (US)

(72) Inventor: Dale Gene Malott, Middlebury, IN (US)

(73) Assignee: Dometic Corporation, Louisville, KY (US)

( * ) Notice: Subject to any disclaimer, the term of this patent is extended or adjusted under 35 U.S.C. 154(b) by 546 days.

(21) Appl. No.: 13/773,726

(22) Filed: Feb. 22, 2013

(65) Prior Publication Data

US 2013/0157557 A1 Jun. 20, 2013

Related U.S. Application Data

(62) Division of application No. 11/943,195, filed on Nov. 20, 2007, now Pat. No. 8,535,127.

(60) Provisional application No. 60/860,752, filed on Nov. 22, 2006.

(51) Int. Cl.

| | |
|---|---|
| ***F24F 13/00*** | (2006.01) |
| ***F24F 13/10*** | (2006.01) |
| ***F24F 13/06*** | (2006.01) |

(52) U.S. Cl.

CPC ..... *F24F 13/10* (2013.01); *F24F 13/06* (2013.01); *F24F 2221/14* (2013.01)

(58) Field of Classification Search

CPC ..... F24F 13/06; F24F 13/10; F24F 2221/14; F24F 2013/0616; F24F 7/10; F24F 13/08; F24F 2013/0608; E04B 9/02

USPC ..... 454/277, 298, 324

See application file for complete search history.

(56) References Cited

U.S. PATENT DOCUMENTS

| | | | | |
|---|---|---|---|---|
| RE24,637 | E | 4/1959 | Wulle | |
| 3,092,009 | A | 6/1963 | Goettl | |
| 3,528,359 | A * | 9/1970 | Sand | F24F 13/12 454/324 |
| 3,680,468 | A | 8/1972 | Schueler | |
| 3,867,486 | A | 2/1975 | Nagele | |
| 3,974,755 | A | 8/1976 | Honmann | |

(Continued)

FOREIGN PATENT DOCUMENTS

| | | |
|---|---|---|
| CA | 1011592 | 6/1977 |
| EP | 0180053 | 10/1985 |

(Continued)

OTHER PUBLICATIONS

"10-Minute Tech", published in Trailer Life, Jul. 1996, pp. 69-70.

(Continued)

*Primary Examiner* — Steven B McAllister
*Assistant Examiner* — Ko-Wei Lin
(74) *Attorney, Agent, or Firm* — Middleton Reutlinger

(57) ABSTRACT

An air distribution apparatus for mounting with respect to an air conditioning port in a ceiling surface is provided. The air distribution apparatus includes at least one bracket and an air distribution device. The at least one bracket includes a body portion and a protrusion extending from the body portion. The protrusion includes an abutment surface configured to abut a ceiling surface while the body portion at least partially extends into an air conditioning port of a ceiling surface. The air distribution device is configured to be mounted to the bracket to distribute air from an air conditioning port in a ceiling surface.

6 Claims, 27 Drawing Sheets

(56) References Cited

U.S. PATENT DOCUMENTS

| | | | | |
|---|---|---|---|---|
| 4,189,987 | A | 2/1980 | Amberg et al. | |
| 4,502,467 | A | 3/1985 | Smith | |
| 4,608,834 | A | 9/1986 | Rummel | |
| 4,665,804 | A | 5/1987 | Miyasaka | |
| 4,672,818 | A | 6/1987 | Roth | |
| 4,693,174 | A | 9/1987 | Anderson | |
| 4,709,623 | A | 12/1987 | Roth et al. | |
| 5,056,262 | A * | 10/1991 | Schweiss et al. | 49/56 |
| 5,366,149 | A | 11/1994 | Kline | |
| 5,435,781 | A | 7/1995 | Kitchens | |
| 5,494,244 | A | 2/1996 | Walton | |
| 5,501,634 | A | 3/1996 | Wilder | |
| 5,531,641 | A | 7/1996 | Aldrich | |
| 5,556,335 | A | 9/1996 | Holyoake | |
| 5,588,910 | A | 12/1996 | Hutter et al. | |
| 5,752,877 | A | 5/1998 | Sun | |
| 5,863,310 | A | 1/1999 | Brown et al. | |
| 5,964,910 | A | 10/1999 | Keele | |
| 6,066,041 | A * | 5/2000 | Hernandez et al. | 454/201 |
| 6,076,370 | A | 6/2000 | Da Silva | |
| 6,101,829 | A | 8/2000 | Robinson | |
| 6,171,062 | B1 | 1/2001 | Bucher et al. | |
| 6,196,914 | B1 | 3/2001 | Lyu | |
| 6,250,373 | B1 | 6/2001 | Vecchi et al. | |
| 6,302,780 | B1 | 10/2001 | Ahn et al. | |
| 6,370,899 | B1 | 4/2002 | Hobbs et al. | |
| 6,370,906 | B1 | 4/2002 | Kuo | |
| 6,415,622 | B2 | 7/2002 | Kim et al. | |
| 6,554,880 | B1 * | 4/2003 | Northcutt | B01D 46/0006 454/292 |
| 6,571,572 | B2 | 6/2003 | Hobbs et al. | |
| 6,601,356 | B2 | 8/2003 | Snyder | |
| 6,616,523 | B1 | 9/2003 | Tani et al. | |
| 6,745,586 | B1 | 6/2004 | Reimann et al. | |
| 6,857,953 | B2 | 2/2005 | Malott | |
| 8,171,866 | B2 * | 5/2012 | Dunstan | 109/70 |
| 2003/0162492 | A1 * | 8/2003 | Caferro et al. | 454/289 |
| 2003/0220070 | A1 * | 11/2003 | Orendorff | 454/324 |
| 2004/0038643 | A1 | 2/2004 | Katagiri et al. | |
| 2005/0087332 | A1 | 4/2005 | Umeo et al. | |
| 2005/0227609 | A1 | 10/2005 | Koessler | |
| 2007/0157522 | A1 * | 7/2007 | Hebert et al. | 49/413 |

FOREIGN PATENT DOCUMENTS

| | | |
|---|---|---|
| EP | 0064769 | 8/1986 |
| EP | 1681517 | 7/2006 |
| EP | 1832452 | 9/2007 |
| FR | 2087220 | 12/1971 |
| GB | 2297157 | 7/1996 |
| JP | 52137854 | 11/1977 |
| JP | 2004125338 | 4/2004 |

OTHER PUBLICATIONS

"Duo-Therm" by Dometic, p. 140.

Australian Government IP Australia, Examiner's First Report on patent application No. 2007237183 dated Aug. 30, 2011, pp. 1-3.

Australian Government IP Australia, Examiner's First Report on patent application No. 2012261549 dated Mar. 27, 2015, pp. 1-5.

Werner, Juk, Baudelio & Cia., S.C., Letter translating Mexican Office Action for MX Patent Application MX/a/2012/007619, pp. 1-3 dated Mar. 7, 2016.

Werner, Juk, Baudelio & Cia., S.C., Letter translating Office Action for MX Patent Application MX/a/20071014688, pp. 1-2 dated Oct. 30, 2012.

Werner, Juk, Baudelio & Cia., S.C., Letter translating Mexican Office Action for MX Patent Application MX/a/2012/007620, pp. 1-3 dated Mar. 30, 2016. Mar. 30, 2016.

Werner, Juk, Baudelio & Cia., S.C., Letter translating Mexican Office Action for MX Patent Application MX/a/3/2012/007619, pp. 1-3 dated Feb. 16, 2017.

* cited by examiner

AIR DISTRIBUTION APPARATUS

CROSS-REFERENCE TO RELATED APPLICATIONS

This application is a divisional application of U.S. Ser. No. 11/943,195, filed on Nov. 20, 2007, which claims the benefit of U.S. Provisional Application No. 60/860,752, filed Nov. 22, 2006, the entire disclosures of which are hereby incorporated by reference.

FIELD OF THE INVENTION

The present invention relates generally to air distribution apparatus, and more particularly, to air distribution apparatus for air conditioners.

BACKGROUND OF THE INVENTION

Air conditioning systems are known to include an air distribution apparatus. Conventional air distribution apparatus typically include air vents to control air direction and air volume. There is a continuing need to provide an air distribution apparatus with desirable functional aspects that are relatively easy to manufacture and install.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, an air distribution apparatus for mounting with respect to an air conditioning port in a ceiling surface is provided. The air distribution apparatus includes at least one bracket and an air distribution device. The at least one bracket includes a body portion and a protrusion extending from the body portion. The protrusion includes an abutment surface configured to abut a ceiling surface while the body portion at least partially extends into an air conditioning port of a ceiling surface. The air distribution device is configured to be mounted to the bracket to distribute air from an air conditioning port in a ceiling surface.

In accordance with another aspect of the present invention, a method of installing an air distribution apparatus including at least one bracket and an air distribution device is provided. The air distribution device includes an air distribution template with a mounting tab and an air distribution cover. The at least one bracket includes a first bracket and a second bracket. The first bracket includes a body portion with a horizontally extending aperture. The method includes the steps of inserting the mounting tab of the air distribution template into the horizontally extending aperture of the first bracket, snapping an area of the second bracket to an area of the air distribution template, fastening the first bracket and the second bracket with respect to an air conditioning port, and attaching the air distribution cover to the air distribution template.

In accordance with still another aspect of the present invention, an air distribution apparatus for mounting with respect to an air conditioning port in a ceiling surface is provided. The air distribution apparatus includes an air distribution device and an air distribution template. The air distribution device includes an air distribution cover including a bottom wall and at least one cover barrier element attached to the bottom wall. The air distribution template includes a body portion and at least one template barrier element attached to the body portion of the air distribution template. The air distribution cover is configured to be mounted with respect to the air distribution template with the cover barrier element and the template barrier element defining at least one double-barrier structure dividing an supply air area from an return air area.

In accordance with still another aspect of the present invention, an air distribution cover includes a sidewall and a bottom wall. The bottom wall includes a supply port comprising a grille and a door. The door is configured to translate with respect to the grille between a fully opened position and a fully closed position. The door includes a biasing member and a grasping element, wherein the grasping element is biased against the grille to maintain a position between the fully opened position and the fully closed position.

In accordance with still another aspect of the present invention, an air distribution cover in air communication with an air conditioning port in a ceiling surface is provided. The air distribution cover includes a side wall, a bottom wall and a side air vent opened and closed through a pivoting cap shaped to conform to a curvature between the side wall and the bottom wall of the air distribution cover in a fully closed position.

In yet another example, an air distribution apparatus for mounting with respect to an air conditioning port in a ceiling surface is provided. The air distribution apparatus includes a cover with a sidewall and a bottom wall defining an interior cavity. The side wall defines a mounting edge extending about a periphery of the cover. The air distribution apparatus further includes an electric box including electrical components, the electric box extending at least partially outside of the interior cavity of the cover.

In another example, a method of installing an air distribution apparatus with respect to an air conditioning port in a ceiling surface is provided. The method includes the steps of providing a cover including an internal cavity and an electric box including electric components. The method further includes the step of mounting the electric box with respect to the cover. The method still further includes the step of mounting the cover and electric box with respect to the ceiling surface such that at least a portion of the electric box extends within an air conditioning port in the ceiling surface.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
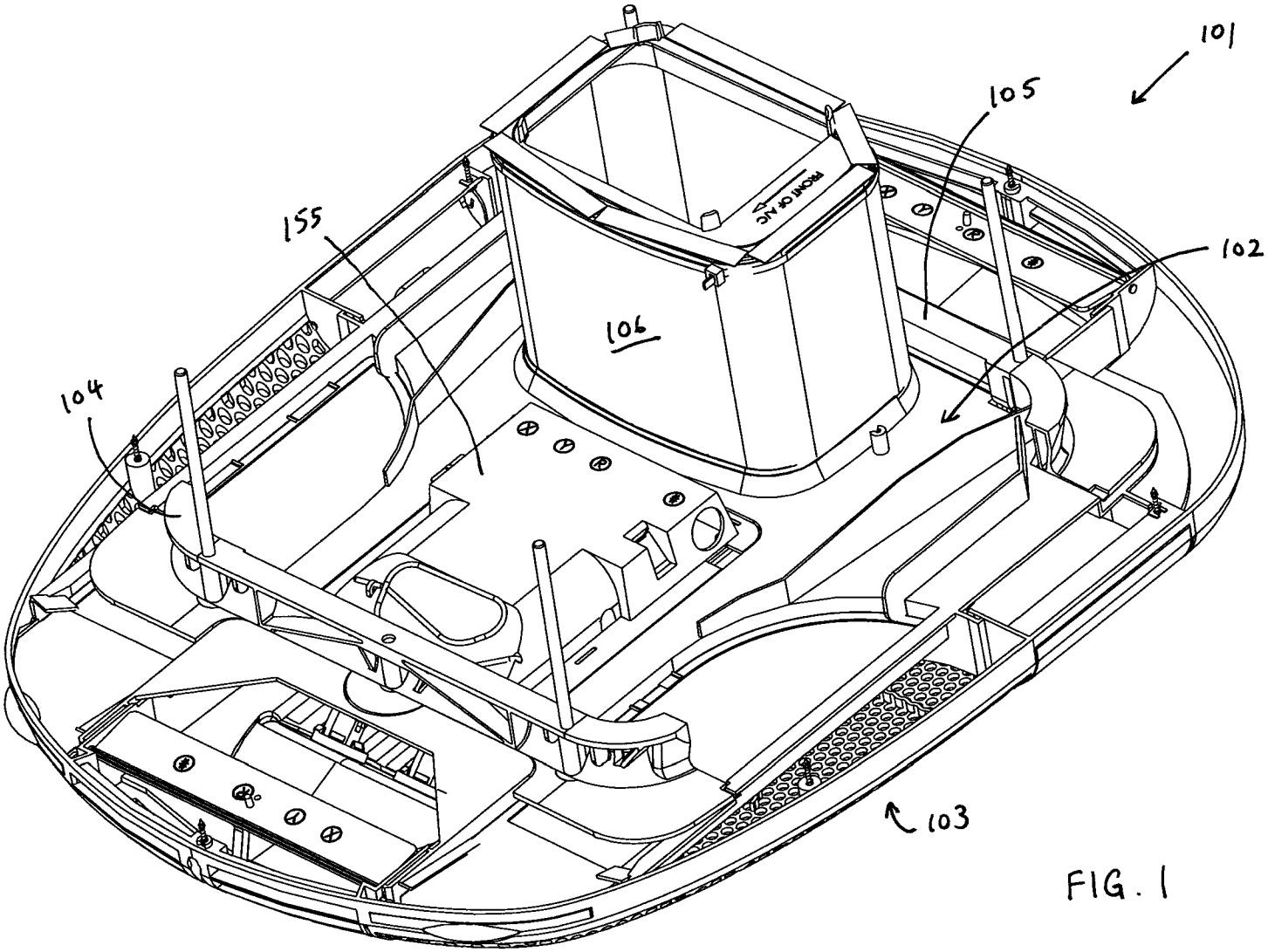
FIG. 1 is a perspective view of an example embodiment of an air distribution apparatus.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Figure 2:
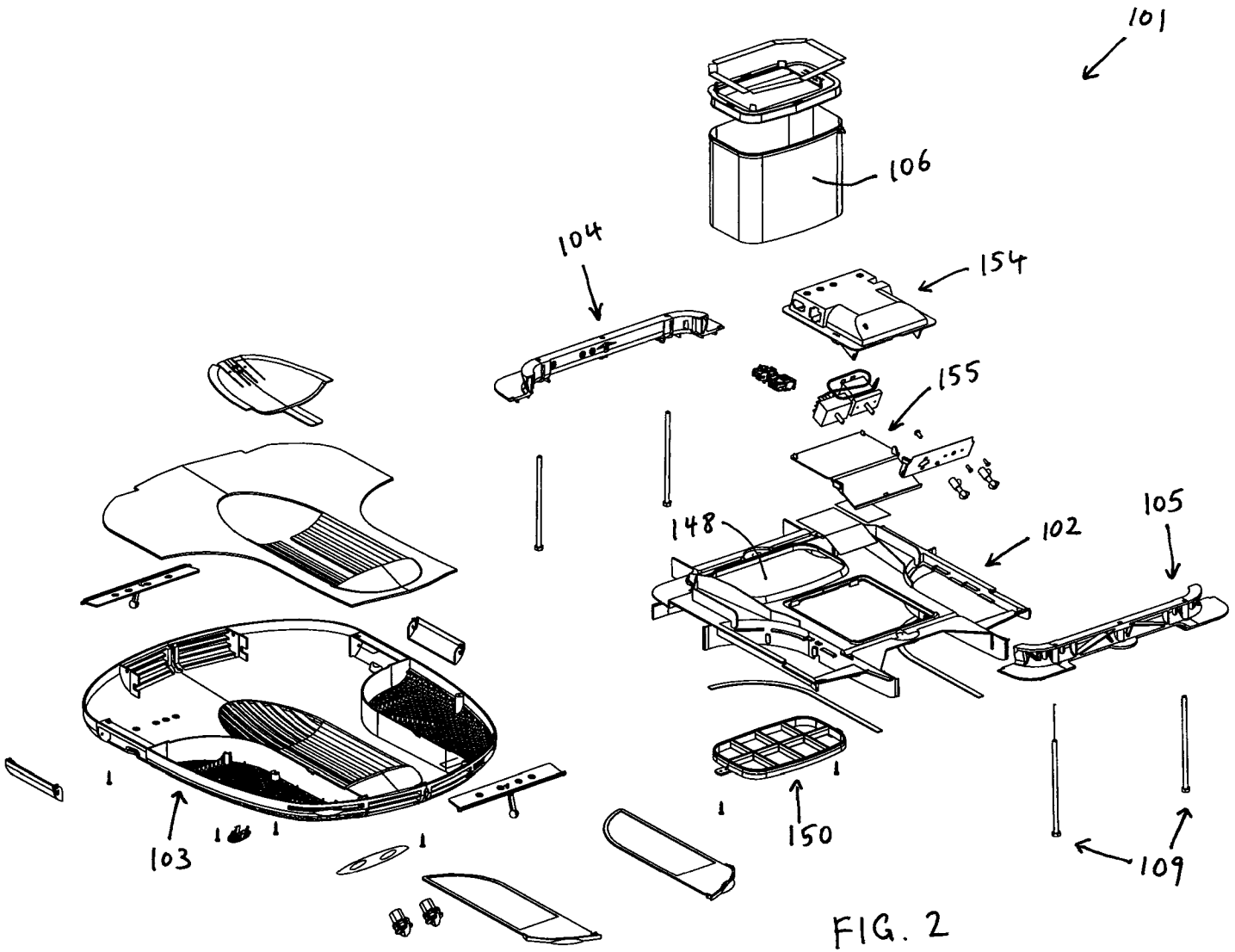
FIG. 2 is an exploded view of the air distribution apparatus.

Turning to the shown example of FIG. 1, an air distribution apparatus 101 for an air conditioner is shown. As shown schematically in FIG. 3C, the air distribution apparatus 101 can be mounted with respect to an air conditioning port 108 in a ceiling surface 111. The ceiling surface 111 can be a surface of a building such as a residential or commercial establishment, a vehicle such as a recreational vehicle, a motor home, a train, a boat, a plane, or any type of structure in which the air conditioning port 108 is located adjacent the ceiling surface 111. As further shown in FIG. 3C, an air conditioner 107 may be installed above the ceiling surface 111 or may abut against a roof surface 113 above the ceiling surface 111. FIG. 2 shows an exploded view of an example embodiment of the air distribution apparatus 101. The air distribution apparatus 101 can include a bracket structure and an air distribution device. The air distribution device can further comprise an air distribution template 102 and an air distribution cover 103.

Figure 3A:
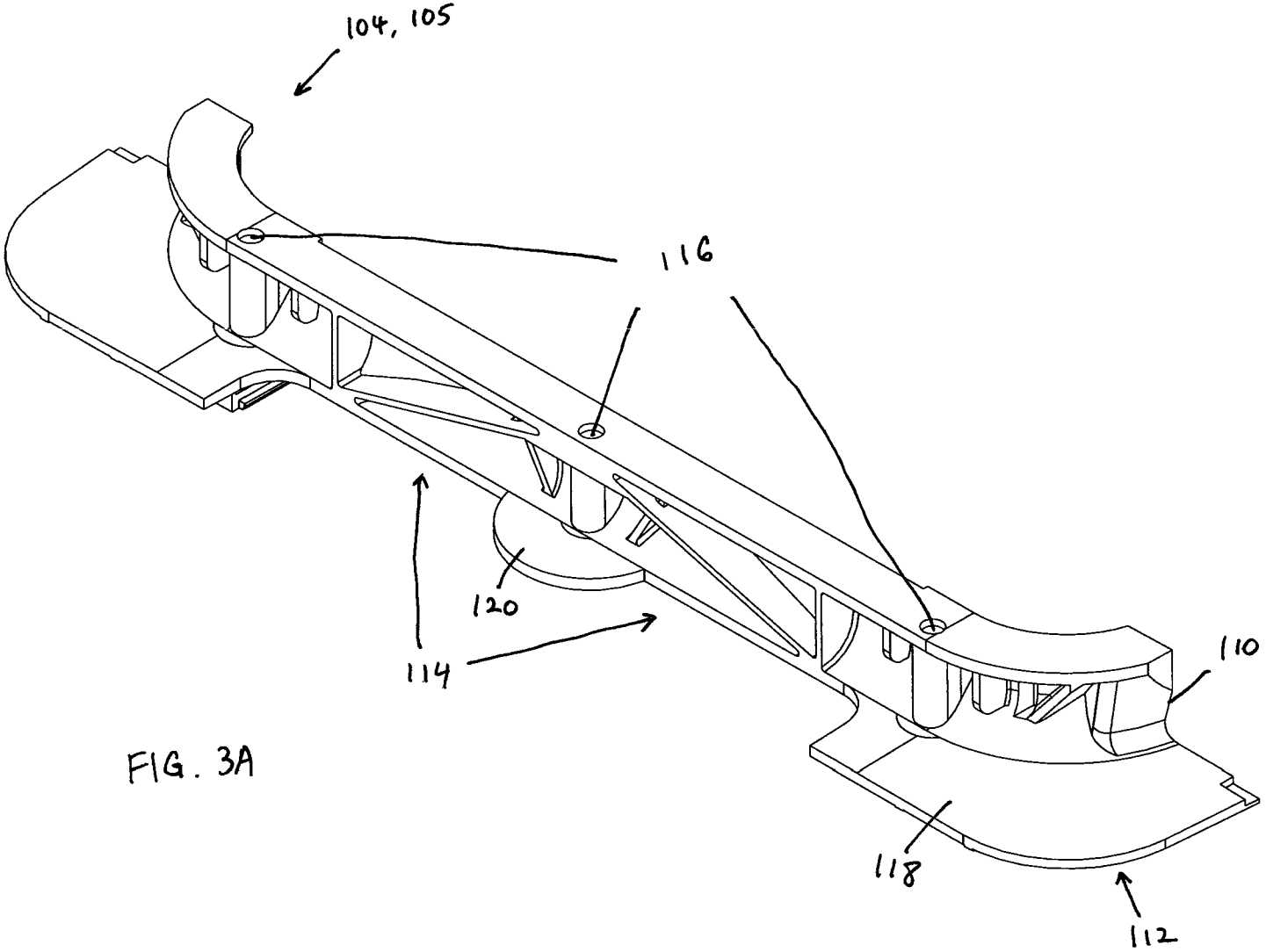
FIG. 3A is a top perspective view of a bracket.
Figure 3B:
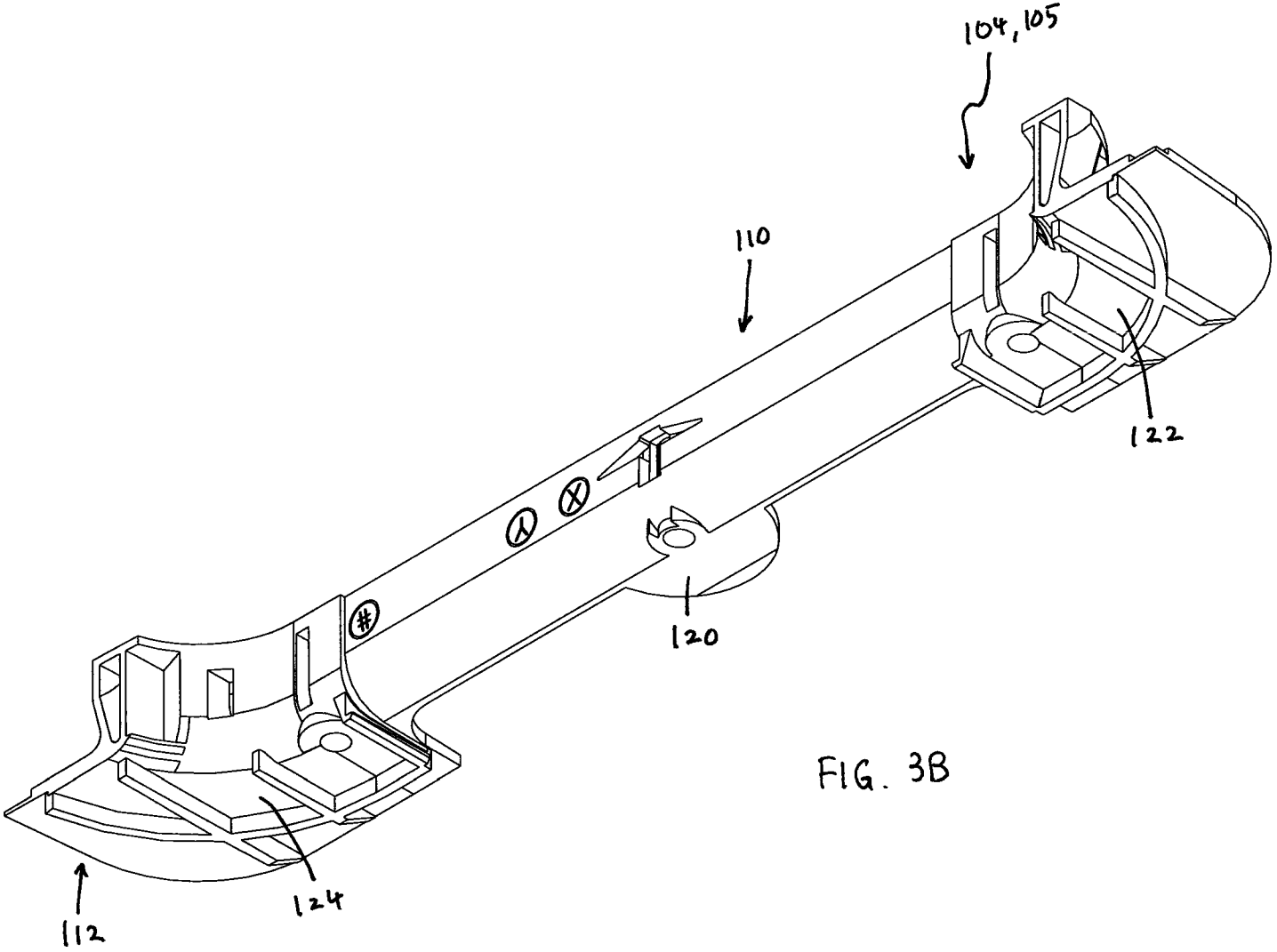
FIG. 3B is a bottom perspective view of the bracket.
Figure 3C:
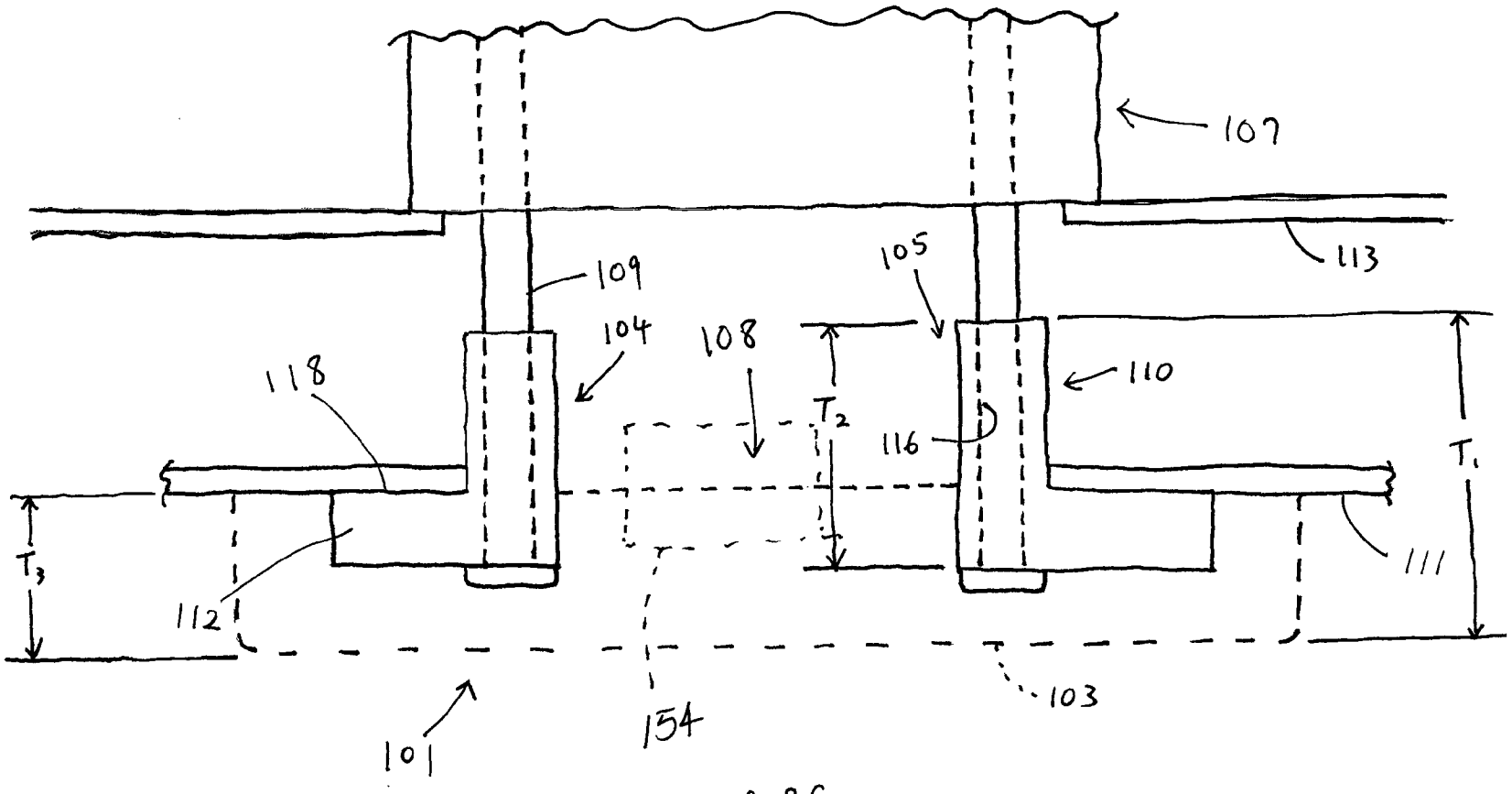
FIG. 3C is a schematic side view of the bracket mounted with respect to an air conditioning port.

As shown in FIGS. 2, 3A, 3B and 3C, the bracket structure can comprise a pair of brackets 104, 105. In one example, the two brackets 104, 105 are substantially identical so as to create a mirror image of one another when they engage longitudinally opposite sides of the air distribution device. The number of brackets constituting the bracket structure can vary and it is possible to have two brackets that are not identical to one another. As shown in FIGS. 3A and 3B, the bracket 104 and/or 105 of FIG. 3 can include a body portion 110 and a protrusion 112 that extends from the body portion 110. In an assembled position, the body portion 110 can be oriented vertically although non-vertical orientations may be provided in further examples. As further shown, the protrusion 112 can extend horizontally at an approximate 90° angle with respect to the body portion 110 although other angle orientations may be provided in further examples. In one example, the body portion 110 can include truss structures 114 that extend substantially from top to bottom of the body portion 110 in order to increase the rigidity of the bracket 104 or 105 and vertically reinforce the bracket 104 or 105. In one example, the truss structure 114 can comprise a network of reinforcing ribs although other truss structures may be used in further examples. In the illustrated example, the truss structure 114 can comprise a plurality of vertical and angled ribs. The bracket 104 or 105 can be substantially C-shaped in cross-section in order to increase rigidity and provide appropriate mounting surfaces. The bracket 104 or 105 can be fabricated with metal, plastic, composite or any other material that is sufficiently rigid to withstand the mounting forces and other operation forces. As shown in FIG. 3C, the body portion 110 may be mounted so that the mounting portion at least partially extends into the air conditioning port 108 in the ceiling surface 111. As shown in FIGS. 2 and 3, the bracket 104 and/or 105 can be secured to the air conditioner 107 through fasteners 109, such as mounting bolts, machine screws or the like. The fasteners 109 can be inserted into vertical fastener openings 116 extending through the body portion 110. As shown in FIG. 3C, the bracket 104 or 105 will be fastened to the air conditioner 107 so that an abutment surface 118 of the protrusion 112 abuts against the ceiling surface 111. The air distribution device can then be mounted to the bracket structure so that the air conditioner 107 can be in fluid communication with the air distribution device. It is also possible to assemble at least a portion of the air distribution device with the bracket structure and then mount this portion of the air distribution device with respect to the ceiling surface 111.

Figure 4:
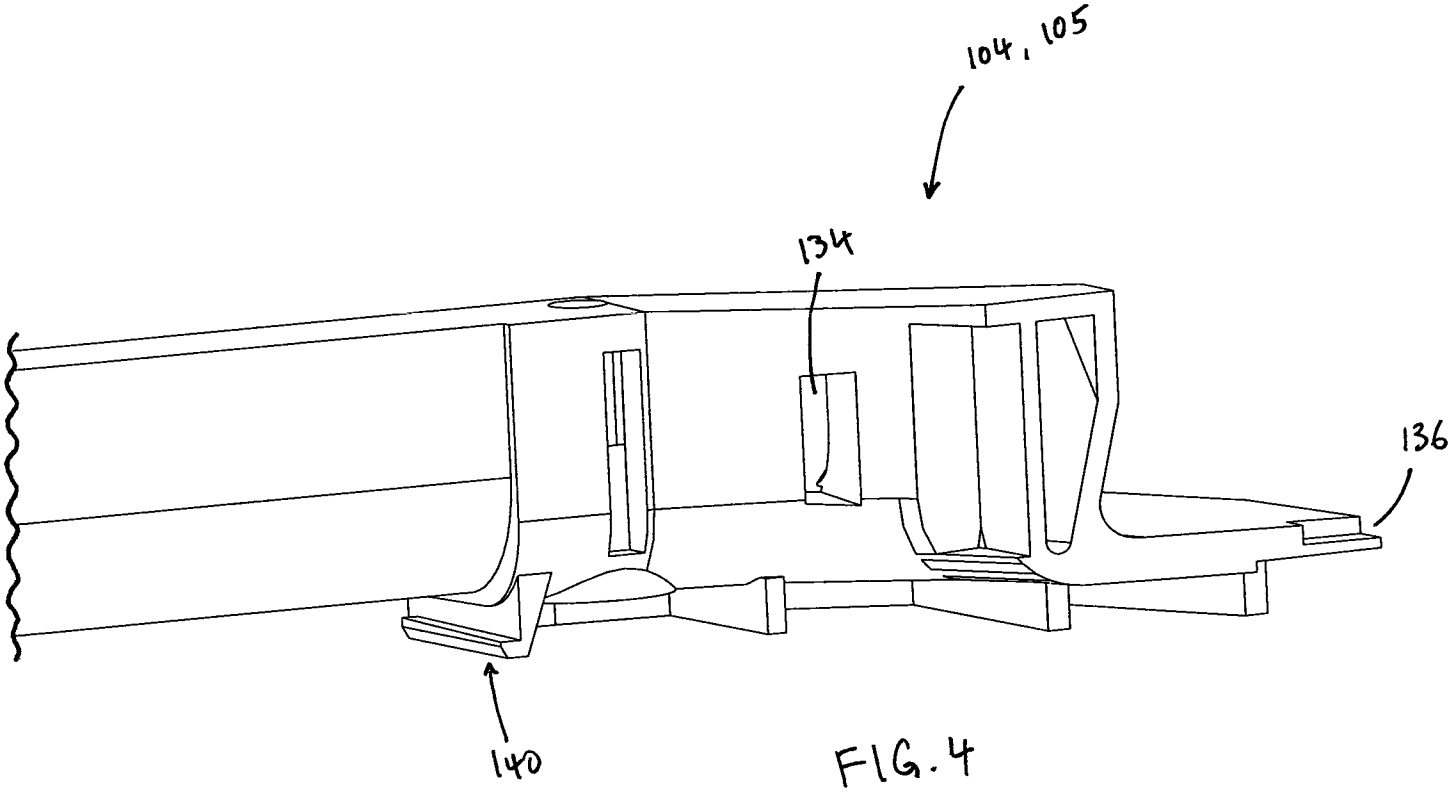
FIG. 4 is an enlarged view of the bracket.
Figure 5:
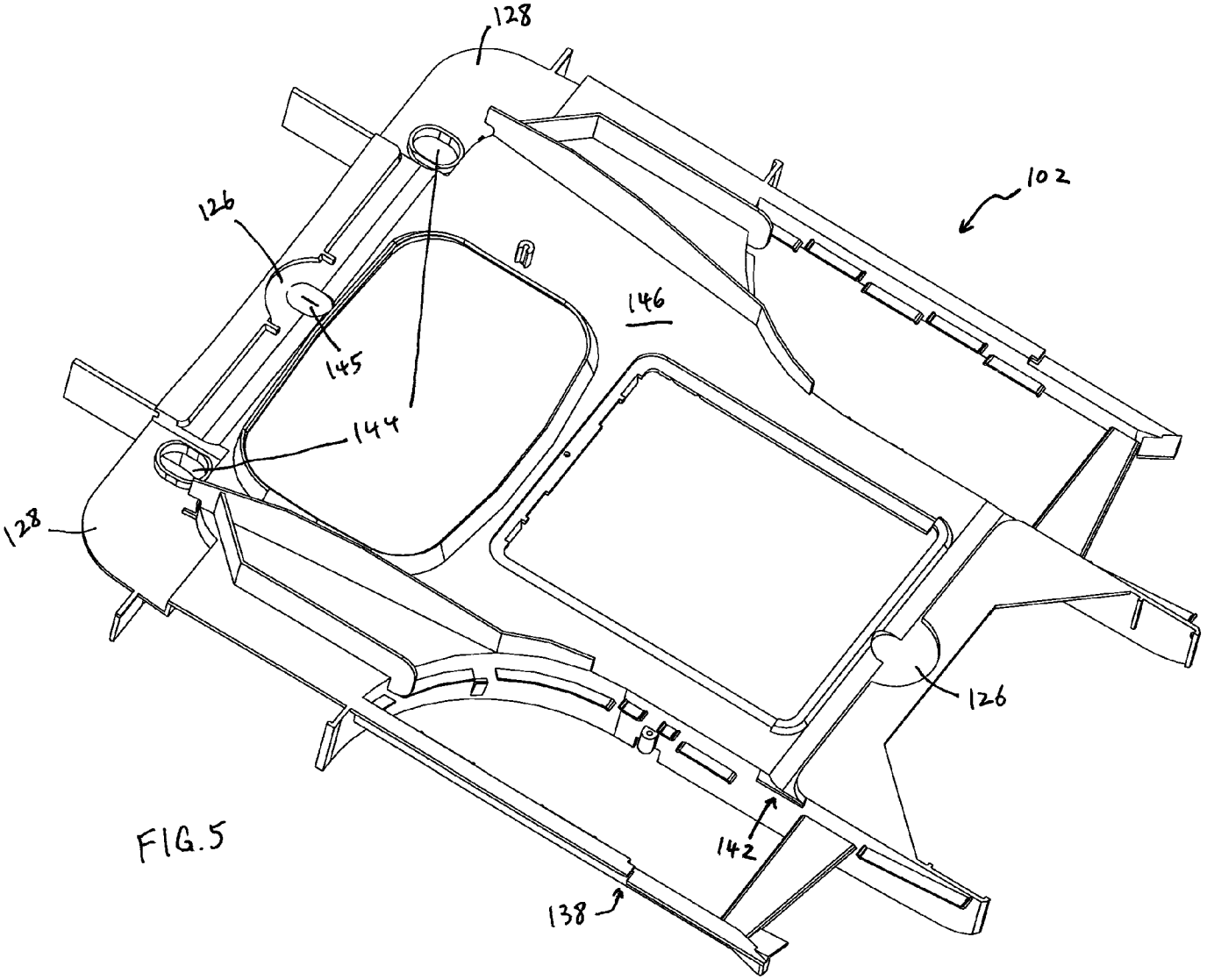
FIG. 5 is a perspective view of an air distribution template.
Figure 6:
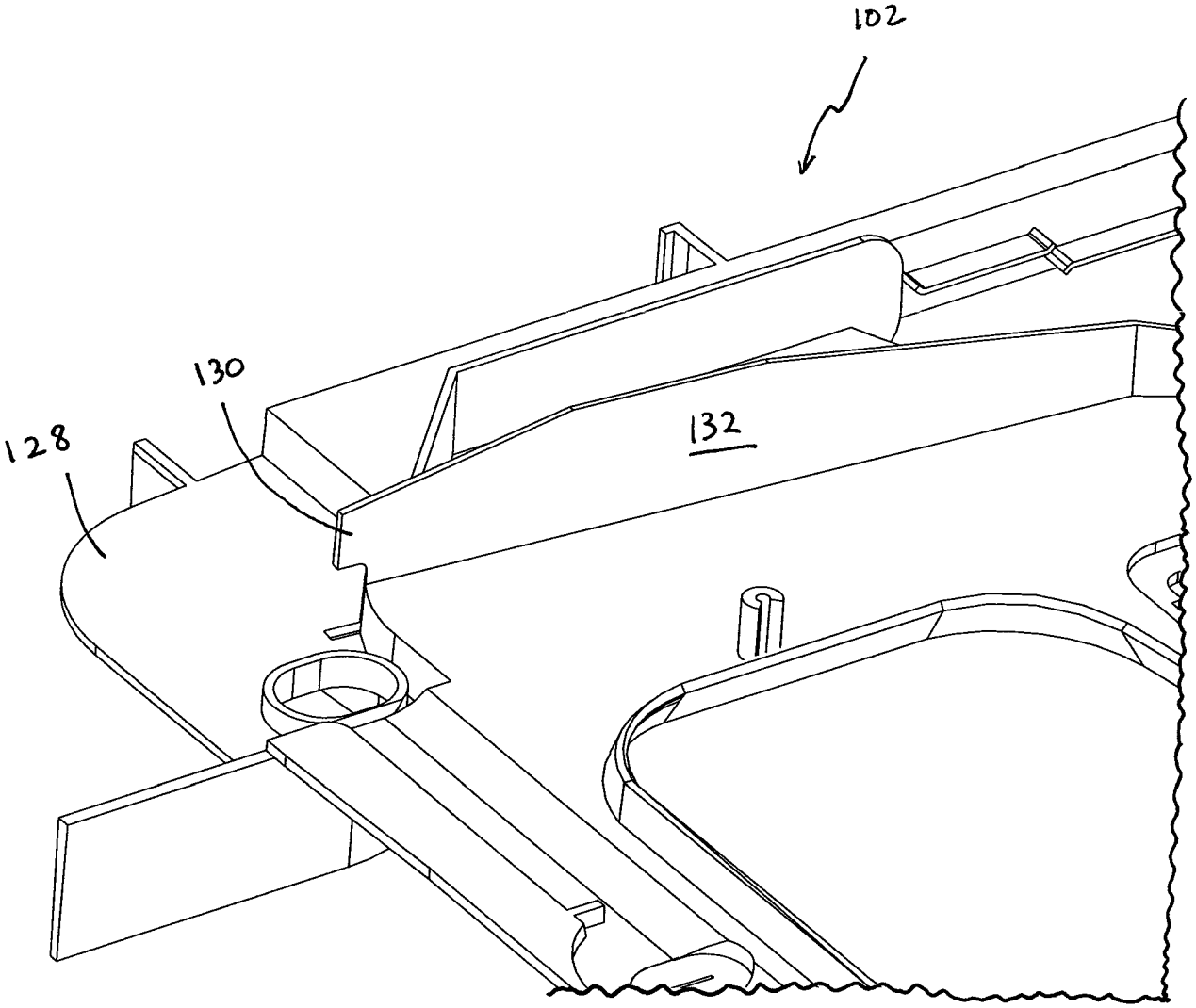
FIG. 6 is an enlarged view of a mounting tab on the air distribution template.
Figure 7:
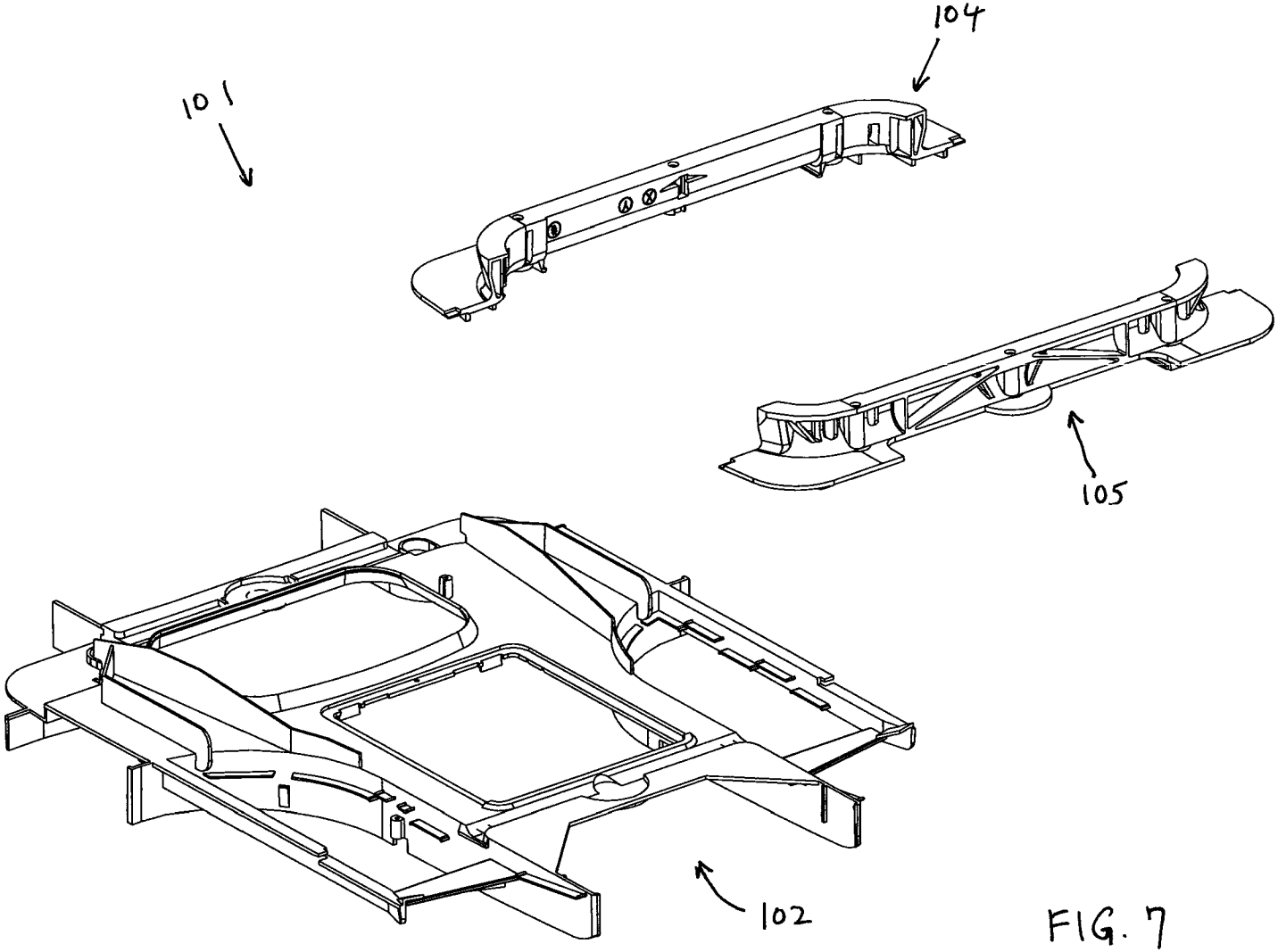
FIG. 7 is an exploded perspective view of the brackets and the air distribution template.
Figure 8:
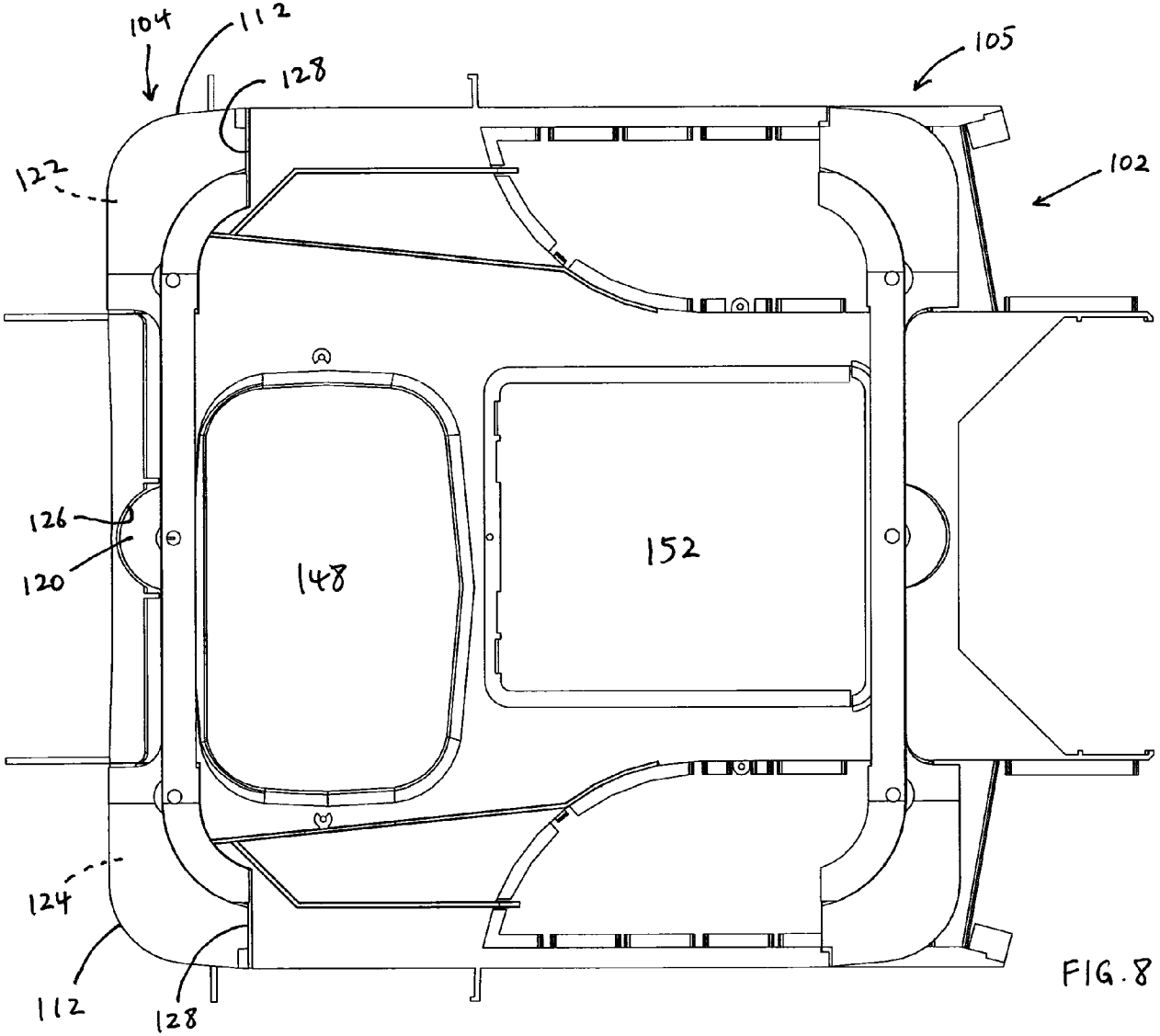
FIG. 8 is a top view of the brackets assembled with the air distribution template.
Figure 9:
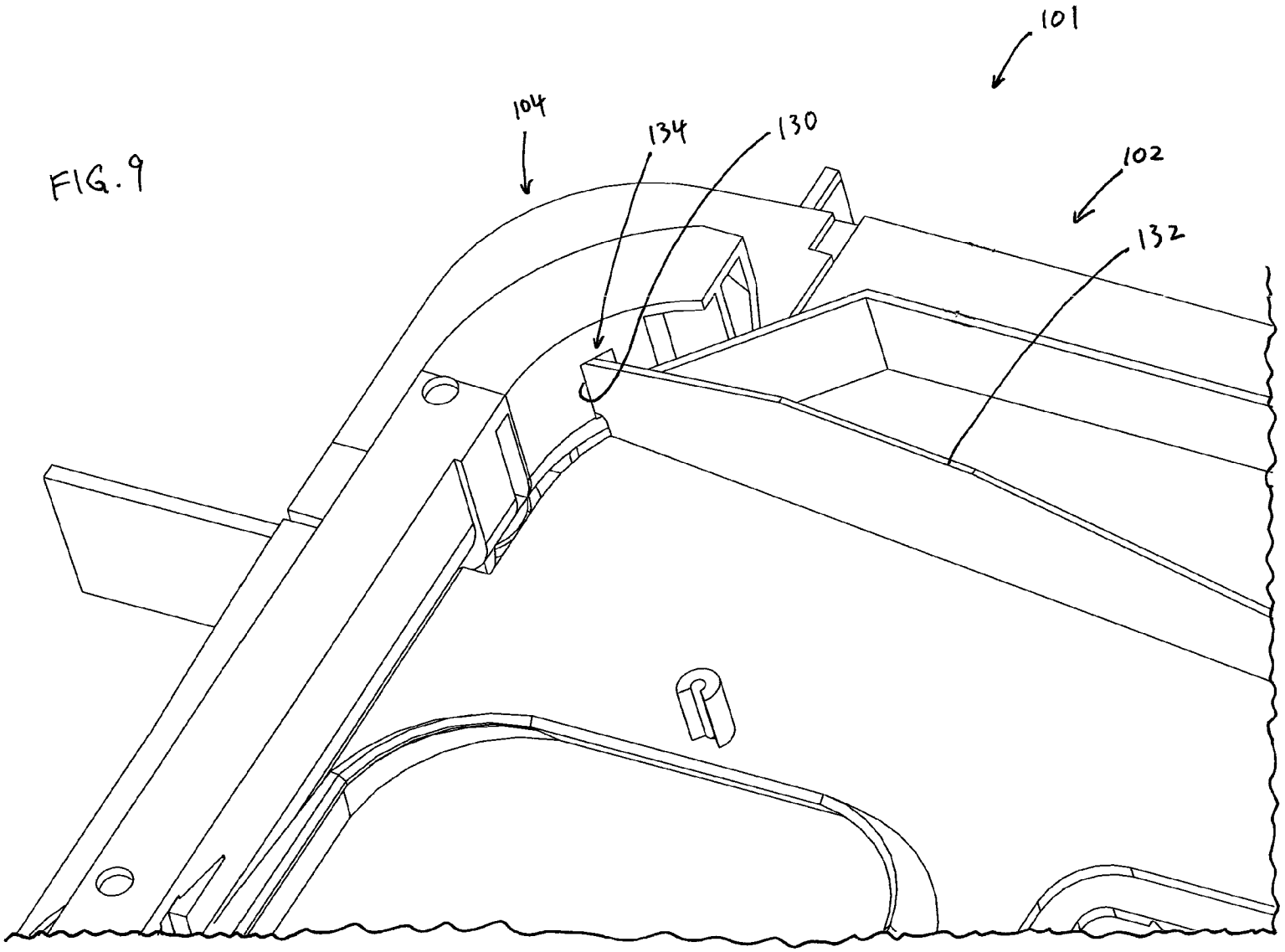
FIG. 9 is a first enlarged view of a bracket assembled with the air distribution template.
Figure 10:
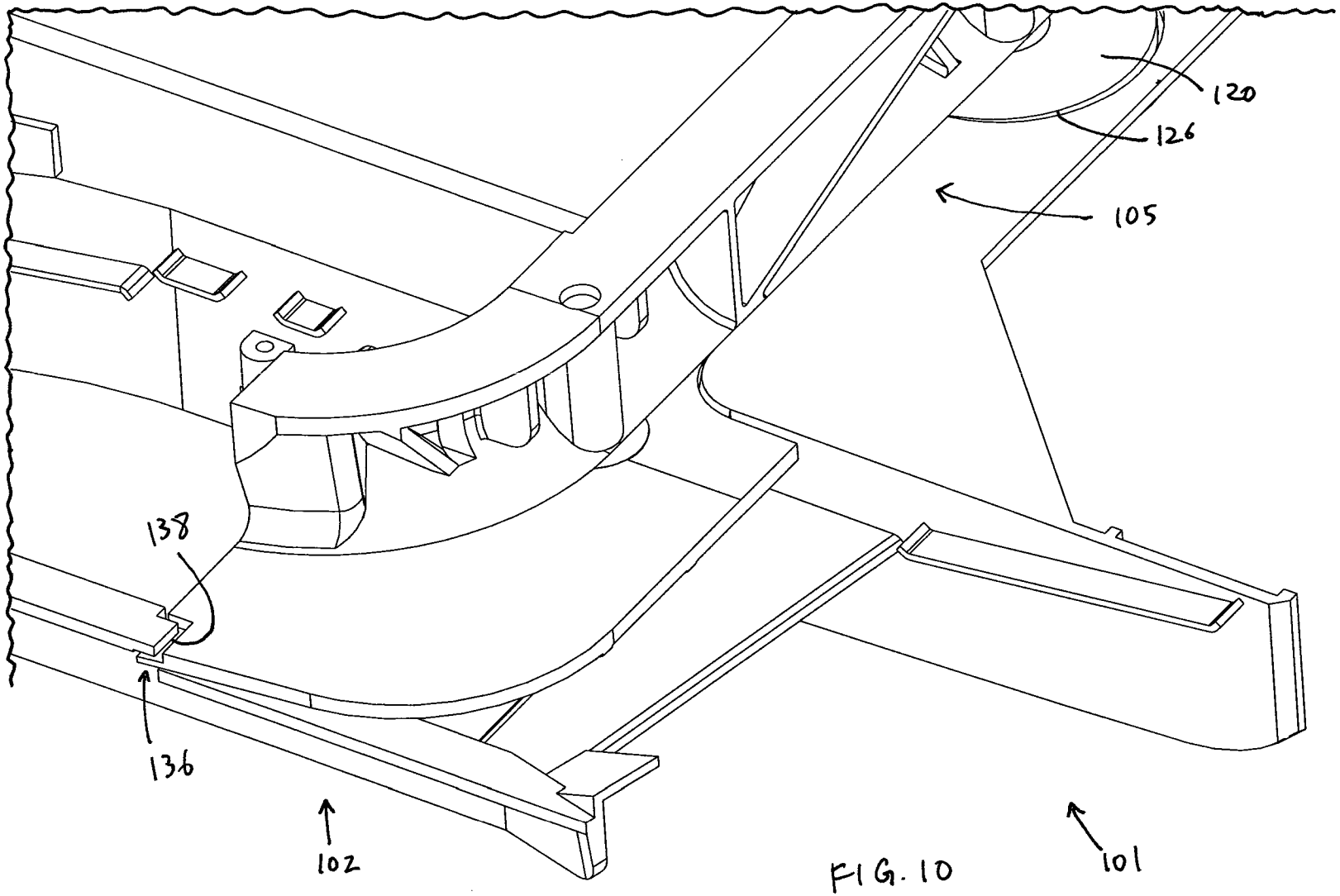
FIG. 10 is a second enlarged view of another bracket assembled with the air distribution template.

FIGS. 7 and 8 show the example brackets 104, 105 and the example air distribution template 102 in an exploded state and assembled state respectively. The brackets 104, 105 include features that enable mounting of the brackets to the air distribution template 102. As shown in FIG. 8, a semi-circular locating tab 120 (see also FIGS. 3A and 3B) and feet 122, 124 (see also FIG. 3B) of the protrusion 112 of the body portion 110 fit into recessed portions 126, 128 (see also FIG. 5) of the air distribution template 102 respectively. The feet 122, 124 are located at the bottom of the protrusion 112 and can be symmetrically disposed on the bracket 104 or 105. In one example, the air distribution template 102 can be provided with first recessed portions 126 on both of the longitudinally opposite sides of the air distribution template 102 while second recessed portions 128 are provided only on one longitudinal side of the air distribution template 102. As shown in FIG. 9, the air distribution template 102 also includes mounting tabs 130 (see also FIG. 6) which are extensions of wall-like portions 132 and mate with horizontally extending apertures 134 (see also FIG. 4) on the bracket 104 or 105. The horizontally extending apertures 134 can be slots, openings, grooves or the like. As shown in FIG. 10, the protrusion 112 of the bracket 104 or 105 also includes indented portions 136 (see also FIG. 4). As shown in FIG. 10, the indented portions 136 are configured to facilitate a snappingly interlocked connection of the bracket 105 with receiving slots 138 (see also FIG. 5) of the air distribution template 102. FIGS. 4 and 5 also show the brackets 104 or 105 including hooks 140 (see FIG. 4) that become snappingly interlocked with latches 142 (FIG. 5) on the air distribution template 102. Both of the brackets 104 and 105 are equipped with these features so that each bracket 104 or 105 can be placed on either of the longitudinally opposite sides of the air distribution template 102. Thus, it will be appreciated that using identical brackets can reduce inventory requirements and complications during assembly.

In the present embodiment, on one side of the air distribution template 102, the horizontally extending apertures 134 of the bracket 104 are used for fastening with the mounting tabs 130 of the air distribution template 102 (see FIG. 9). On the other side of the air distribution template 102, the indented portions 136 and the hooks 140 of the bracket 105 are used for fastening (see FIG. 10). Moreover, the air distribution template 102 is shaped and dimensioned to undergo some deformation before accomplishing connection. Various parts of the air distribution template 102 are accommodated with apertures for fastening the air distribution template 102 and the bracket structure with respect to the air conditioning port. The air distribution template 102 is also provided with openings 144 (see FIG. 5) for alignment with corresponding vertical fastener openings 116 (see FIG. 3A) to allow passage of corresponding fasteners 109. Moreover, a knockout 145 (see FIG. 5) can be provided on the air distribution template 102 for use of an optional corresponding center vertical fastener opening 116 (see FIG. 3A).

Figure 11A:
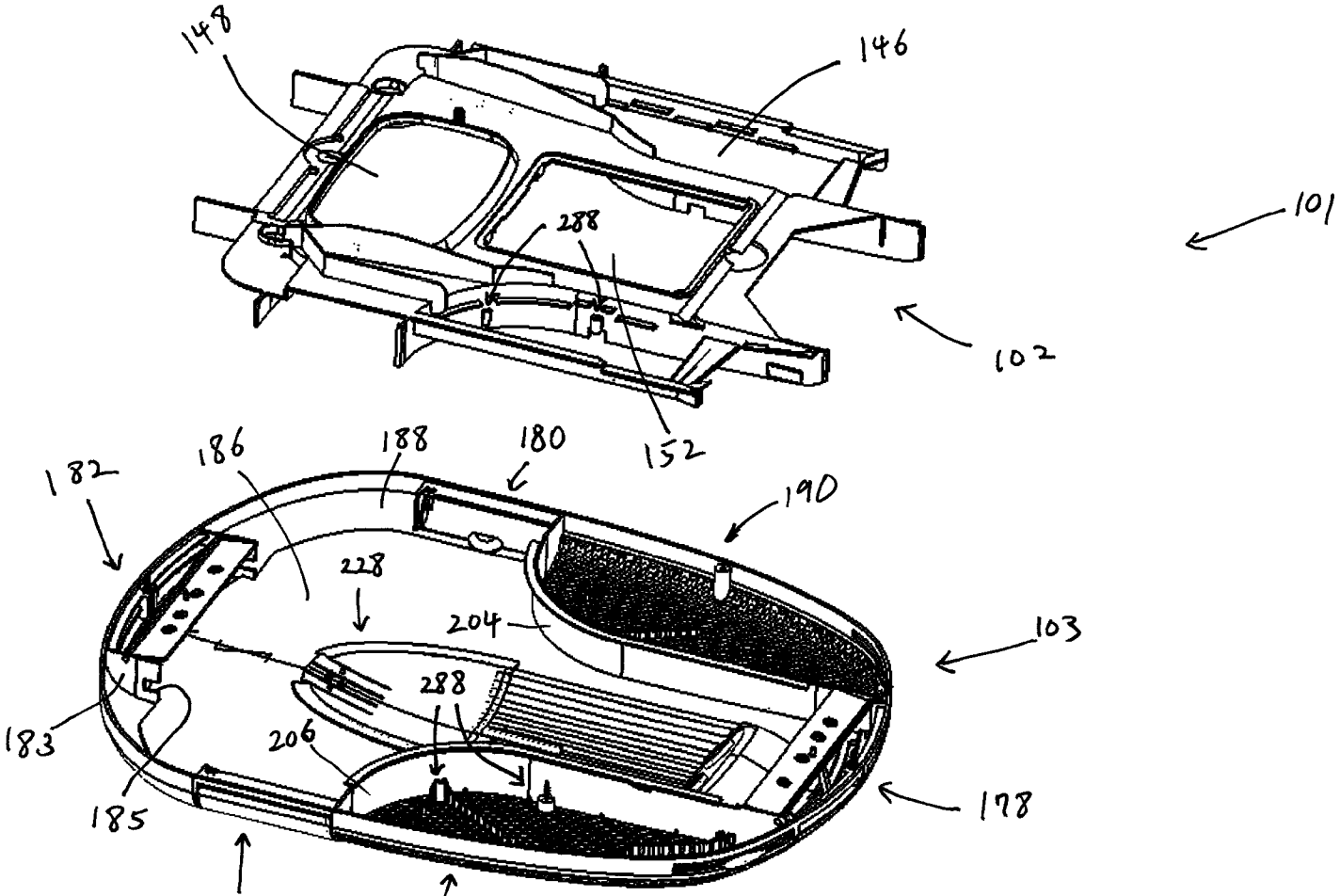
FIG. 11A is an exploded top perspective view of the air distribution template and an air distribution cover.
Figure 11B:
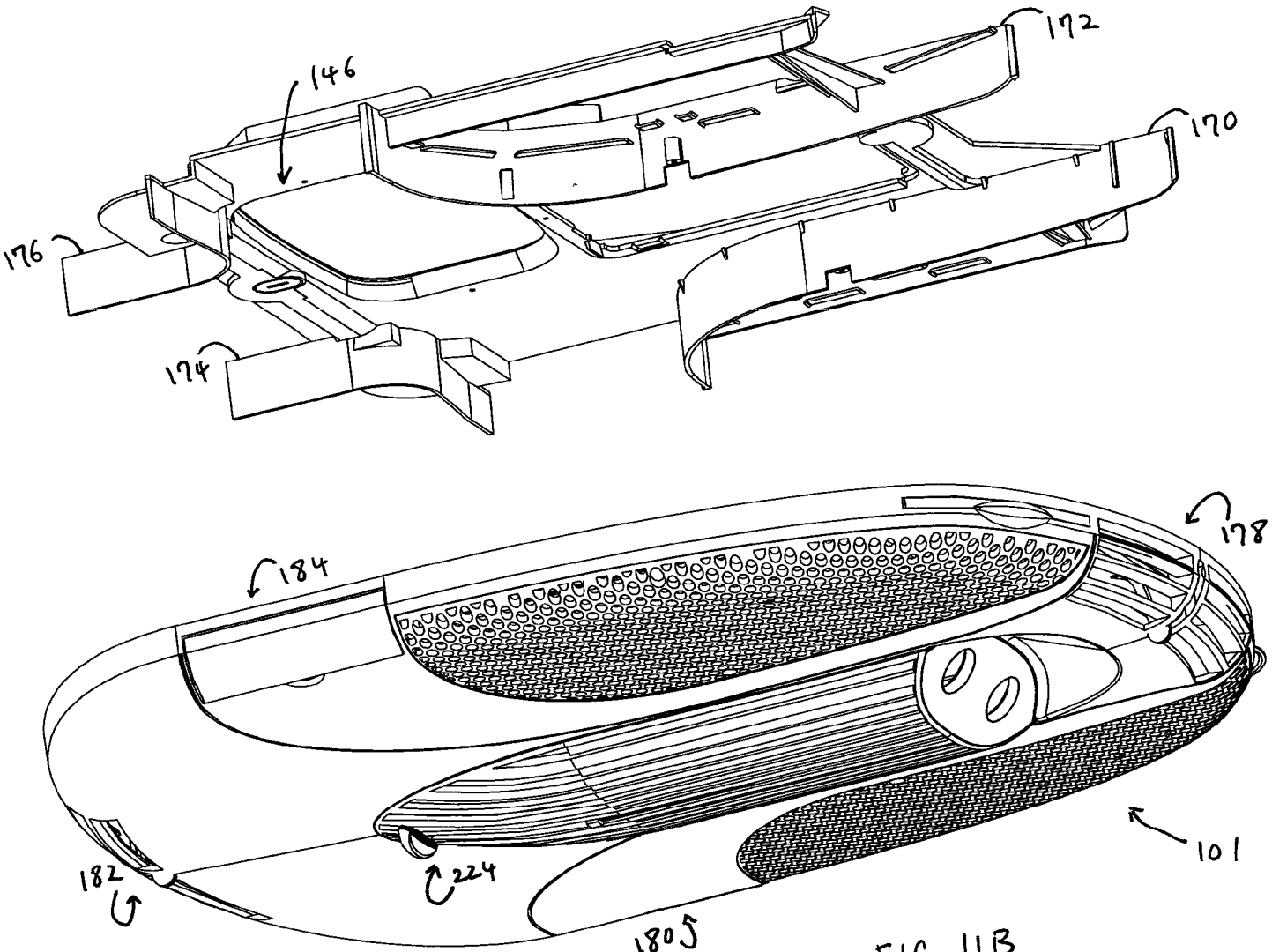
FIG. 11B is an exploded bottom perspective view of the air distribution template and the air distribution cover.
Figure 19:
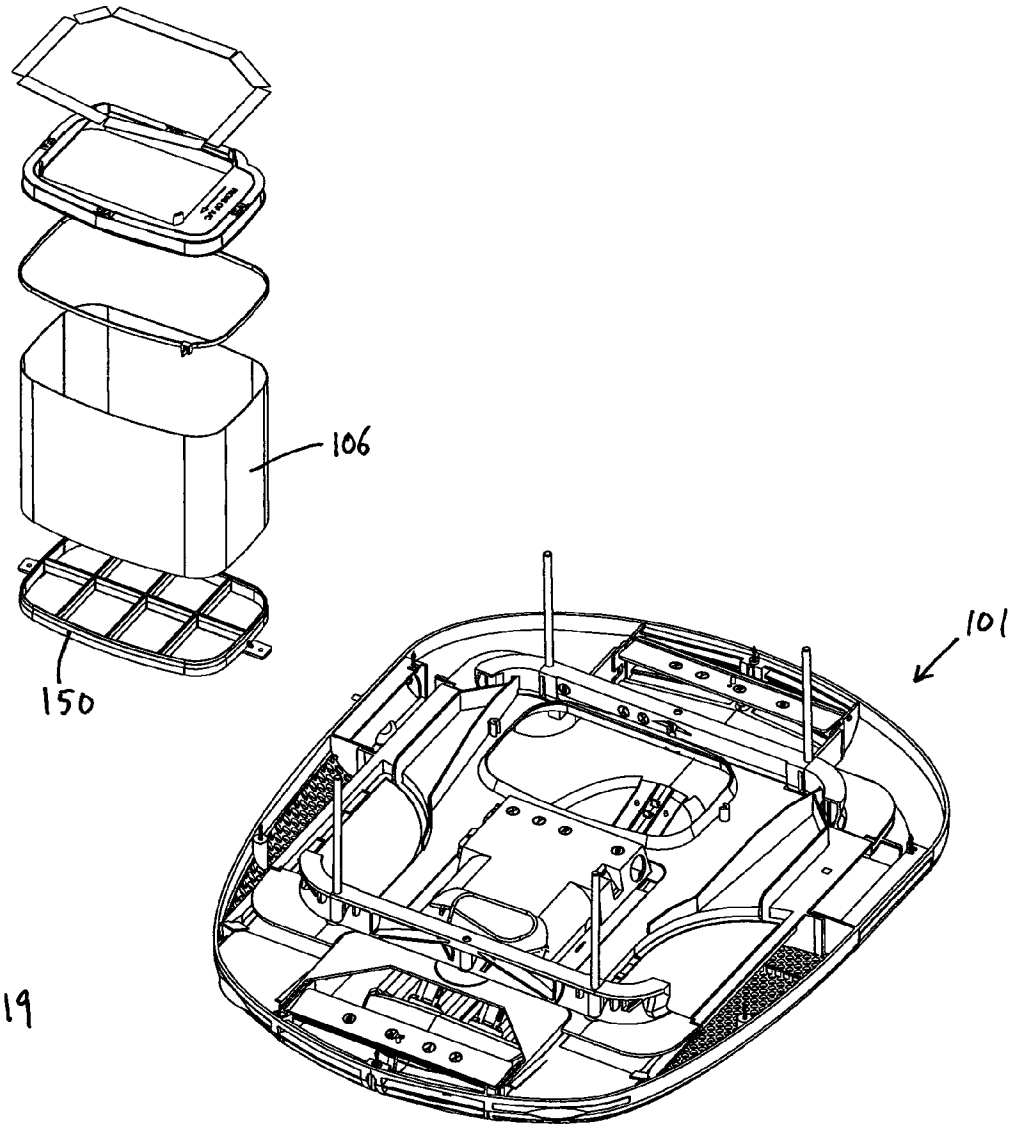
FIG. 19 is an exploded view of a duct attachment assembly.
Figure 20:
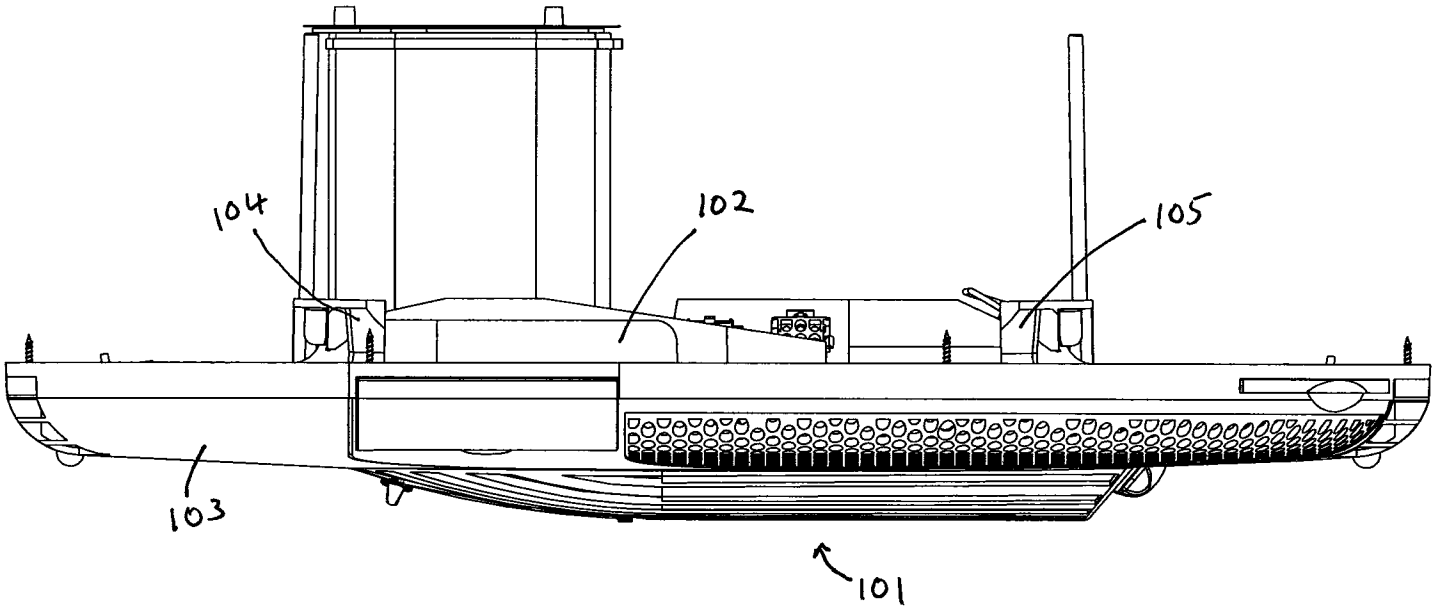
FIG. 20 is a side view of an assembled air distribution apparatus.

FIGS. 11A and 11B show the air distribution template 102 exploded from the air distribution cover 103. The air distribution template 102 has a substantially flat body portion 146 (see also FIG. 5) which can be horizontally oriented after assembly and includes features for accommodating various components and for channeling return and supply air. The air distribution template 102 can be molded with plastic, resin or composite or other material that is sufficiently flexible to deform and engage the bracket structure while capable of sustaining mounting forces. The air distribution template 102 can include a first opening 148 (see FIG. 8) to supply air to an air conditioner 107 by way of a supply air duct 106 (see FIG. 2). Once installed the supply air duct 106 can establish fluid communication between the first opening 148 and the supply port of the air conditioner 107. The supply air duct 106 can be generally of soft material such as fabric so that it can be secured to the air distribution template 102 via a ring 150 that snaps into the first opening 148, as shown in FIG. 2. Excess fabric can be cut off so that the supply air duct 106 is flush with the air distribution template 102 after the ring 150 is snapped in. As shown in FIG. 19, the supply air duct 106 can be secured to the basepan adaptor with wire tie, wire form or hose clamp. The basepan duct adaptor perimeter is reshaped but still snaps to the basepan. Double stick foam may also be used to supplement attachment to the basepan adaptor or screws can be used as an alternative.

Figure 13:
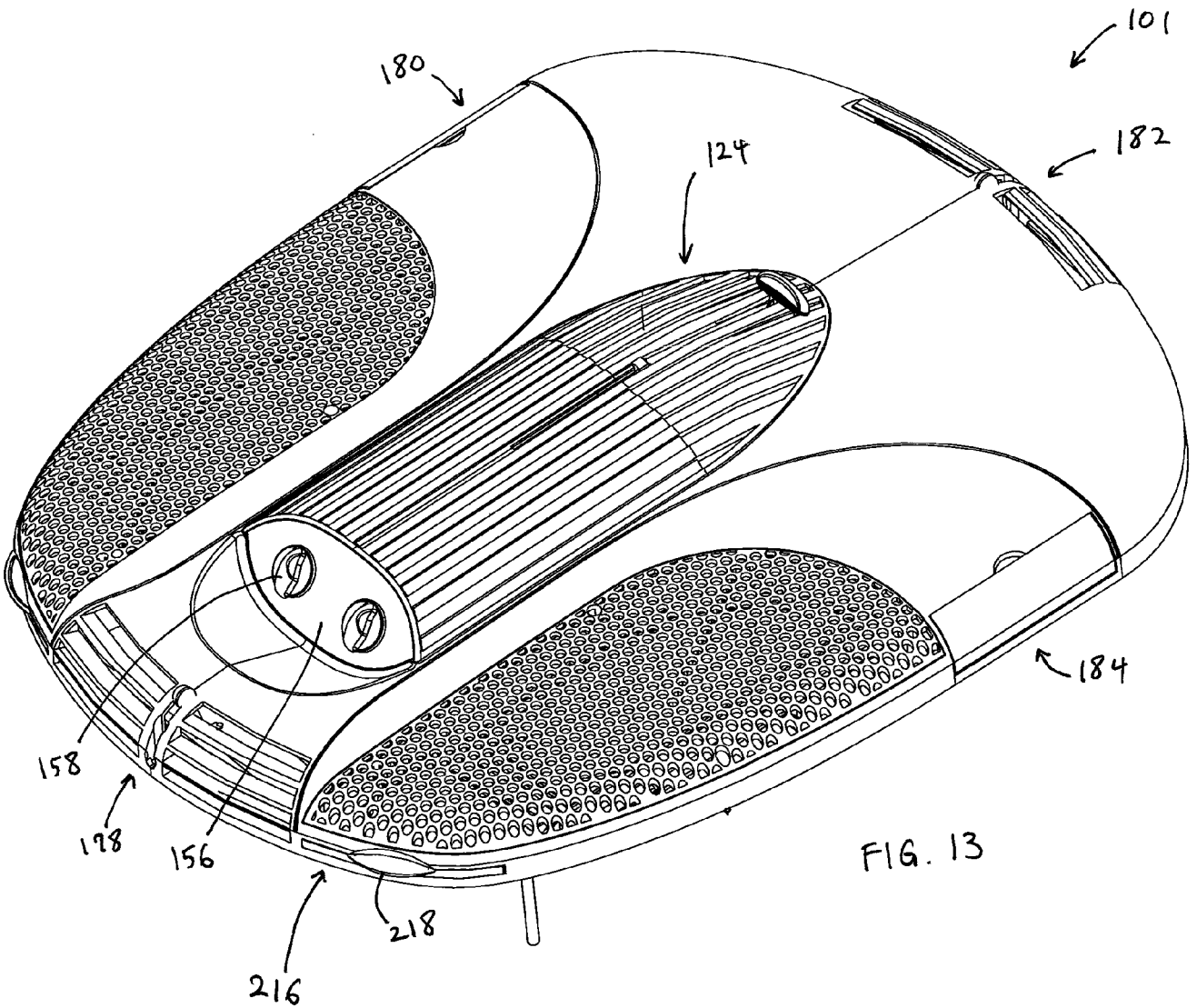
FIG. 13 is a perspective view of the bottom of the air distribution cover.
Figure 18A:
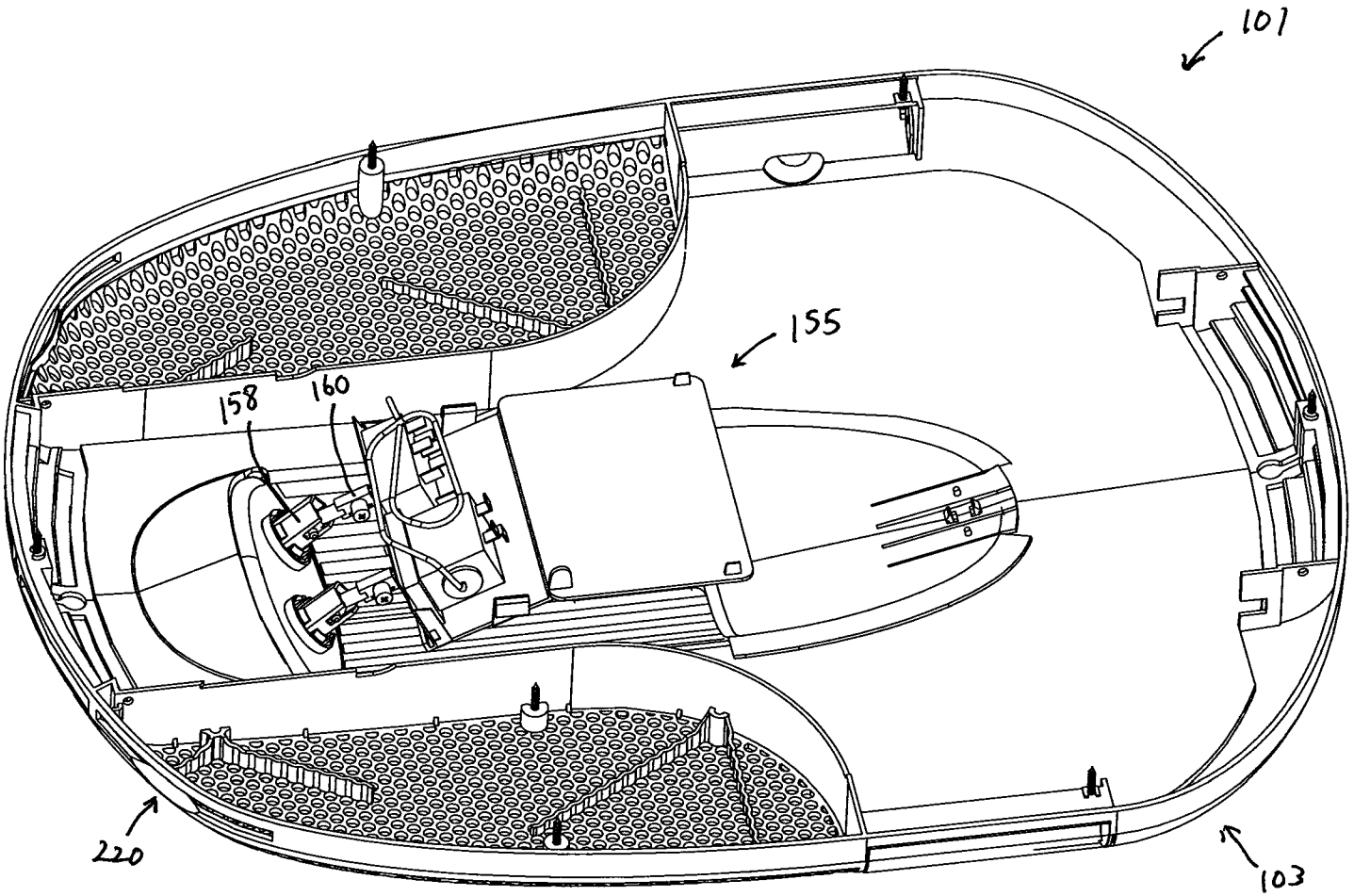
FIG. 18A is an enlarged view of interior components of an electric box of the air distribution apparatus.
Figure 18B:
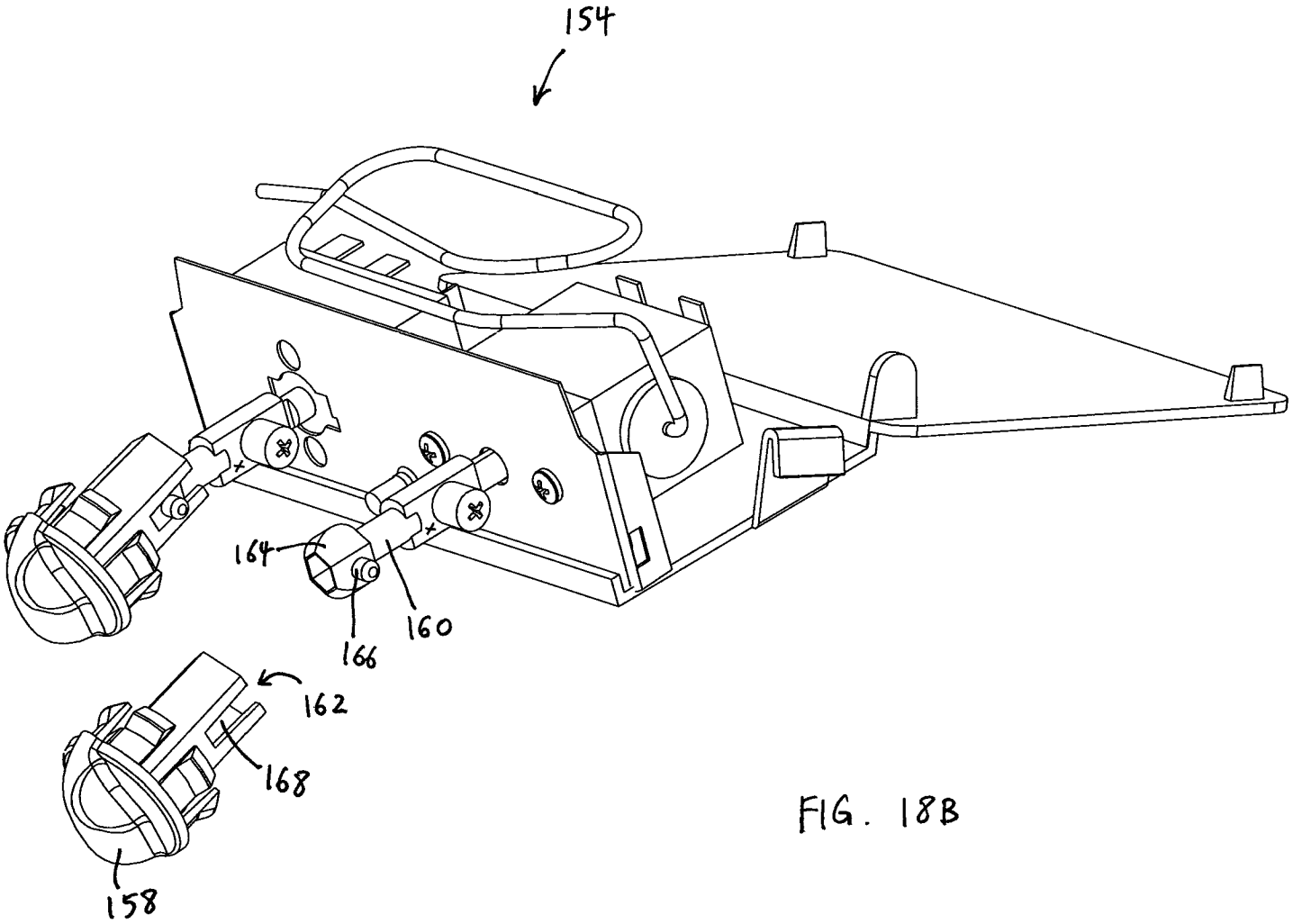
FIG. 18B is a partially exploded view of control knobs and shafts extending from the electric box.

The air distribution template 102 is also provided with a second opening 152 (FIG. 8) for an electric box 154 (FIG. 2) which can be secured to the air distribution template 102 by a snap-in mechanism. The electric box 154 (FIG. 1) can be secured to the air distribution template 102 so that it is minimally, at least partially, or substantially submerged or extended through the air distribution template 102. Such an arrangement between the electric box 154 and the air distribution template 102 can be beneficial by reducing the overall thickness of the air distribution apparatus 101. The air distribution cover 103 can also include a control panel 156 (see FIG. 13) that may be configured to accommodate control knobs 158. The control knobs 158 allow a user to operate the air conditioner 107. As shown in FIG. 18B, the control knobs 158 are in operative engagement with shafts 160 extending from the electric box 154. As shown in FIG. 18B, in the illustrated example embodiment, each control knob 158 includes a socket 162 into which a hexagonal ball 164 at the end of the shaft 160 is inserted. A radial protrusion 166 on the hexagonal ball 164 can be configured to engage a slot 168 provided in the socket 162 so that rotational movement of the control knob 158 is transmitted to the shafts 160. The radial protrusion 166 and the ball-socket connection can provide some margin of error in the alignment of the socket 162 and the shafts 160. In further examples, other structure can be incorporated to provide the operative engagement between the knobs and the shafts. For example, a resilient link can be provided to accommodate some margin of error in the alignment of the knobs and the shafts. Moreover, variations of the hexagonal ball 164 are a hexagonal ball without the protrusion 166 and the slot 168 or a spherical ball with the protrusion 166 and the slot 168. The electric box 154 can include an optional bottom snap-in cover 155 (see FIG. 1) that is placed after the wires are connected.

Figure 12:
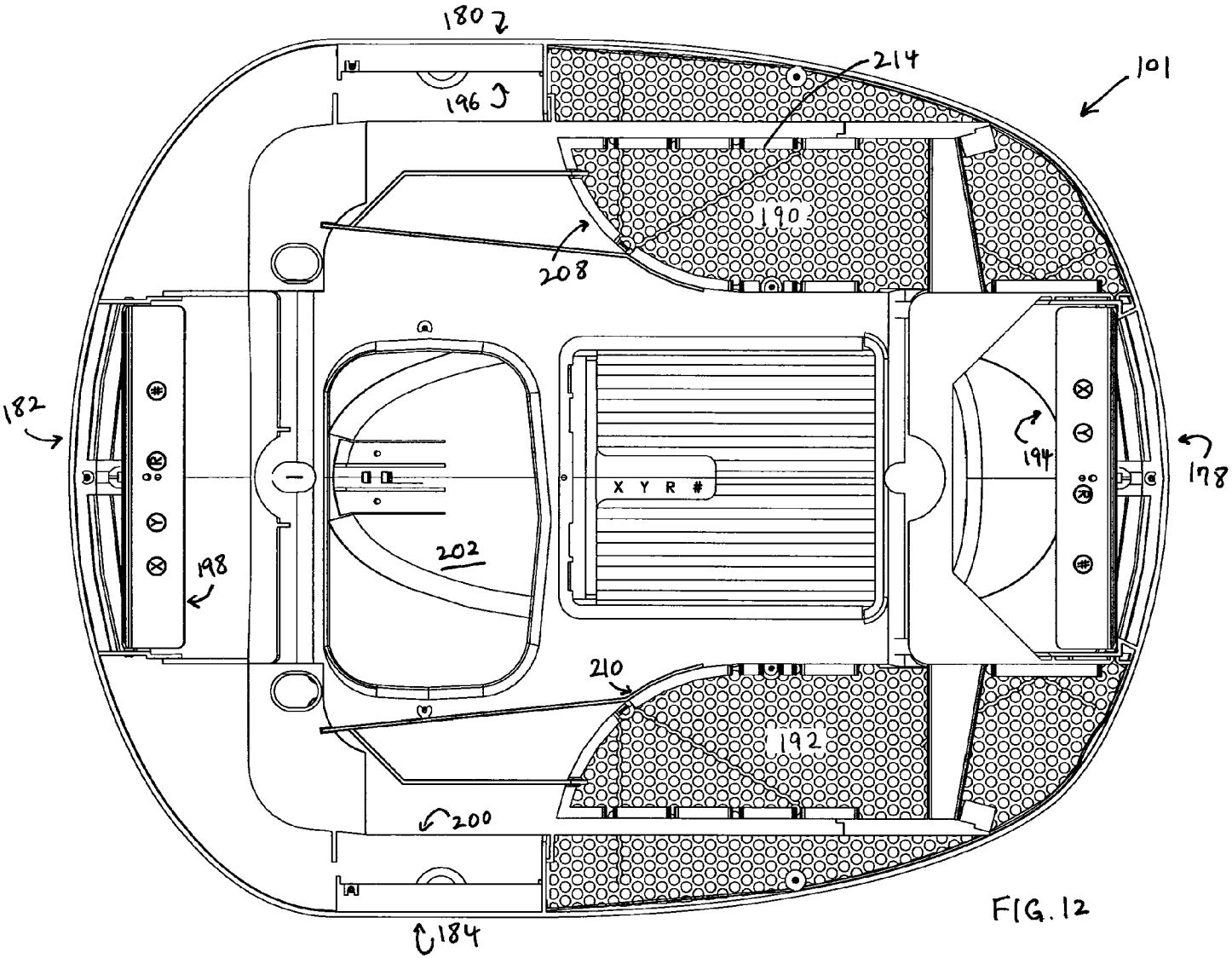
FIG. 12 is a top view of the air distribution template assembled with the air distribution cover.

As shown in FIG. 11B, the air distribution template 102 is further provided with a first pair of template barrier elements 170, 172 and a second pair of template barrier elements 174, 176 to separate return air and supply air or to channel supply air from the air conditioner 107 to air vents 178, 180, 182, 184 of the air distribution cover 103. As shown in FIGS. 11A and 12, the air distribution cover 103 has a bottom wall 186 and a side wall 188, and is provided with return air areas 190, 192 and supply air areas 194, 196, 198, 200, 202. This embodiment of the air distribution cover 103 has a substantially curvilinear shape. The air distribution cover 103 can include two symmetrically located, perforated portions defining the return air areas 190 and 192 and allowing entry of return air into the air distribution apparatus 101. In this embodiment, a pair of cover barrier elements 204, 206 and the first pair of template barrier elements 170, 172 separate the return air areas 190, 192 from the supply air areas 194, 196, 198, 200, 202 and help channel supply air to the side air vents 180, 184 and an end air vent 178. The second pair of template barrier elements 174, 176 also help channel supply air to the side air vents 180, 184 and another end air vent 182. In one example, the cover barrier elements 204, 206 and the first pair of template barrier elements 170, 172 can cooperate to form a double-barrier structure 208, 210 (FIG. 12) for each return air area 190, 192 to ameliorate insulation of the supply air from the return air. In another example, as shown, the cover and template barrier elements 204, 206, 170, 172, 174, 176 can be substantially L-shaped wall-like structures although other structures can be used in further examples. The cover barrier elements 204, 206 may extend upwardly from the bottom wall 186 of the air distribution cover 103 toward the air distribution template 102 (see FIG. 11A) while the first and second pairs of template barrier elements 170, 172, 174, 176 can extend downwardly from the body portion 146 of the air distribution template 102 toward the air distribution cover 103 (see FIG. 11B). The double-barrier structures 208, 210 are respectively formed by one of cover barrier elements 204, 206 and corresponding template barrier elements 170, 172. It will be appreciated that the two corresponding barrier elements 204, 170 and the two corresponding barrier elements 206, 172 can be substantially similar in shape and stand closely parallel to one another after the air distribution cover 103 and the air distribution template 102 are assembled. As such, an insulation gap such as an air gap may be formed between the cover barrier element and the template barrier element in each double-barrier structure 208, 210. A person of ordinary skill in the art will appreciate that variations in the arrangement, shape or number of the supply and return air areas arising from different embodiments of the air distribution template and the air distribution cover are within the scope of this invention.

FIG. 12 shows the air distribution template 102 assembled onto the air distribution cover 103. The present embodiment of the air distribution cover 103 can include two side air vents 180, 184 and two end air vents 178, 182 all of which can be arranged to create an orthogonal arrangement (see FIG. 12), and a downward vent 124. The air distribution cover 103 is the largest of the components of the air distribution apparatus 101 and can comprise a lightweight material such as plastic. The cover barrier elements 204, 206 and the first pair of template barrier elements 170, 172 define supply air paths to one of the end air vents 178 or 182 and the two side air vents 180, 184 while the second pair of template barrier elements 174, 176 defines additional supply air paths to the other end air vent 182 or 178 and the two side air vents 180, 184.

Figure 14:
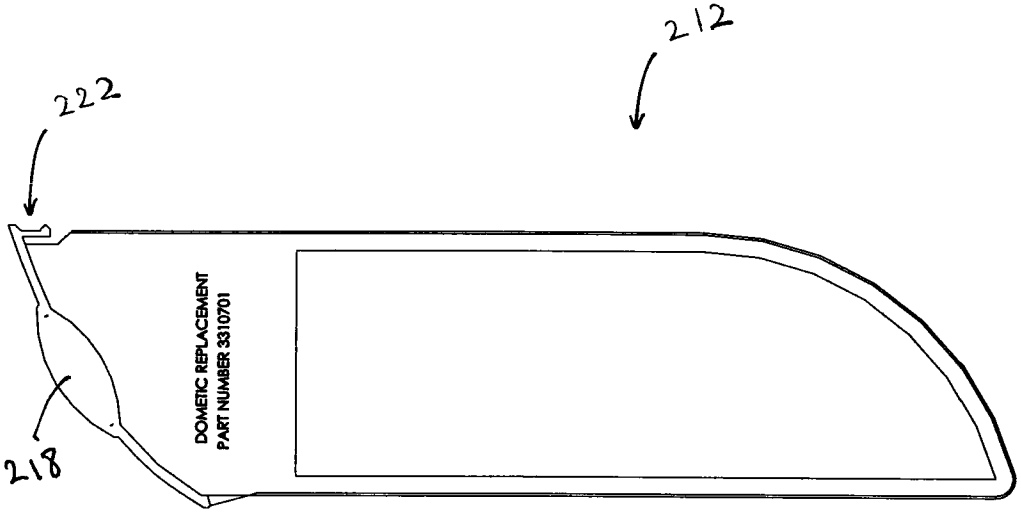
FIG. 14 is a bottom view of an air filter for the air distribution apparatus.

Each of the return air areas 190, 192 can accommodate an air filter 212 (FIG. 14). The air distribution template 102 can include filter supports 214 (see FIG. 12) projecting into the return air area 190, 192. The filter supports 214 can define a space in which the air filter 212 can be slid through and a support surface for the installed air filter 212. As observable from FIG. 12, the air filter 212 is shaped to span across at least a portion of the return air area 190, 192 after it is inserted through a slot 216 (FIG. 13) on the air distribution cover 103. The air filter 212 (FIG. 14) is equipped with a grasping portion 218 while the air distribution cover 103 is equipped with a sunken portion 220 (see FIG. 18A) so that removal of the air filter 212 is facilitated by easy access to the grasping portion 218. The part of the air filter 212 near the grasping portion 218 can be curvilinear in shape to substantially conform to the curvature of the air distribution cover 103 when the air filter 212 is inserted. As shown in FIG. 14, the air filter 212 may also include a latch 222 configured to interlock with a portion of the air distribution cover 103 to hold the air filter 212 in place after insertion.

Figure 15A:
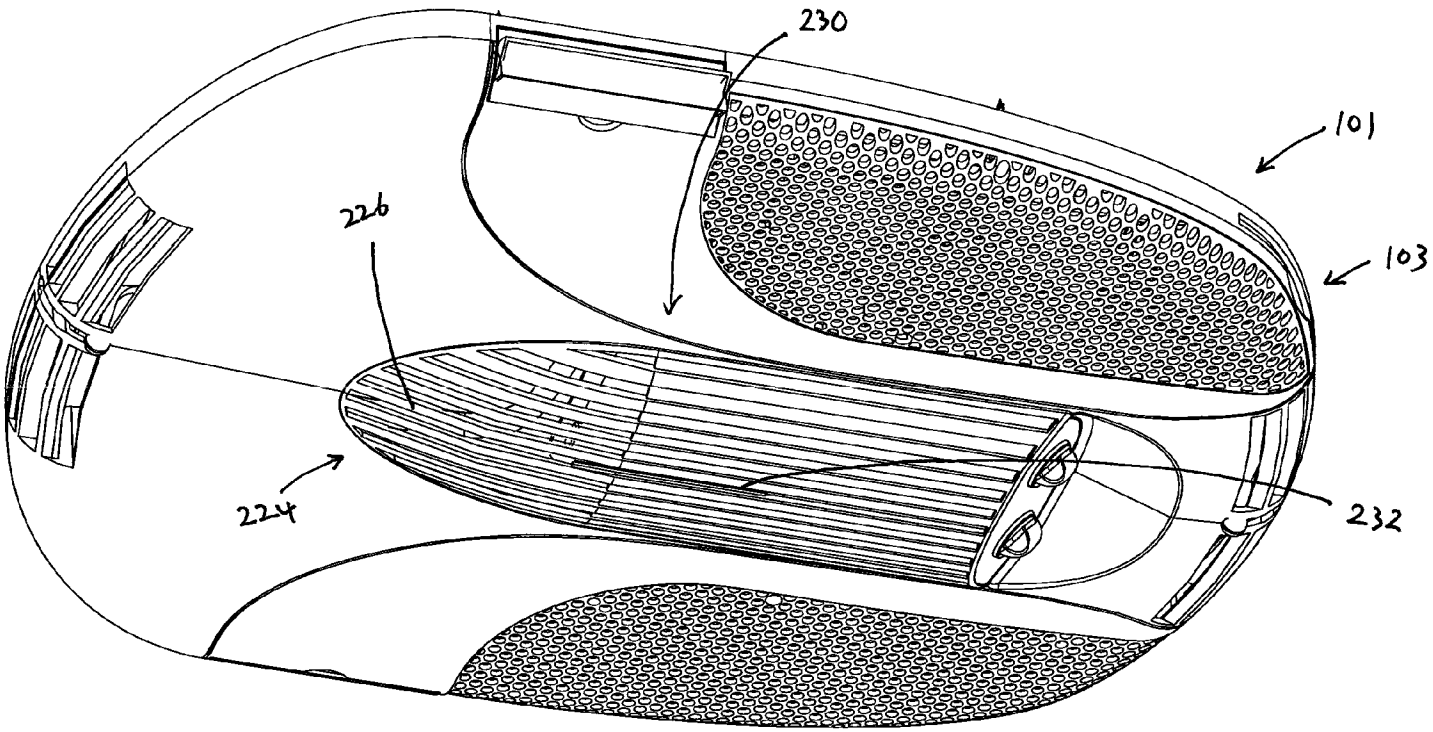
FIG. 15A is an exploded bottom perspective view of a door and the air distribution cover of a downward vent.
Figure 15A:
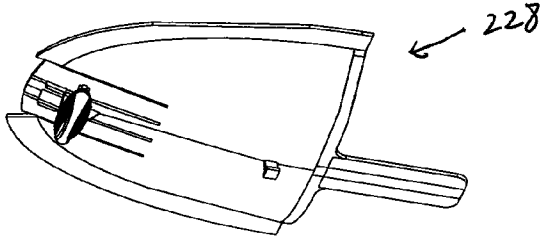
Figure 15B:
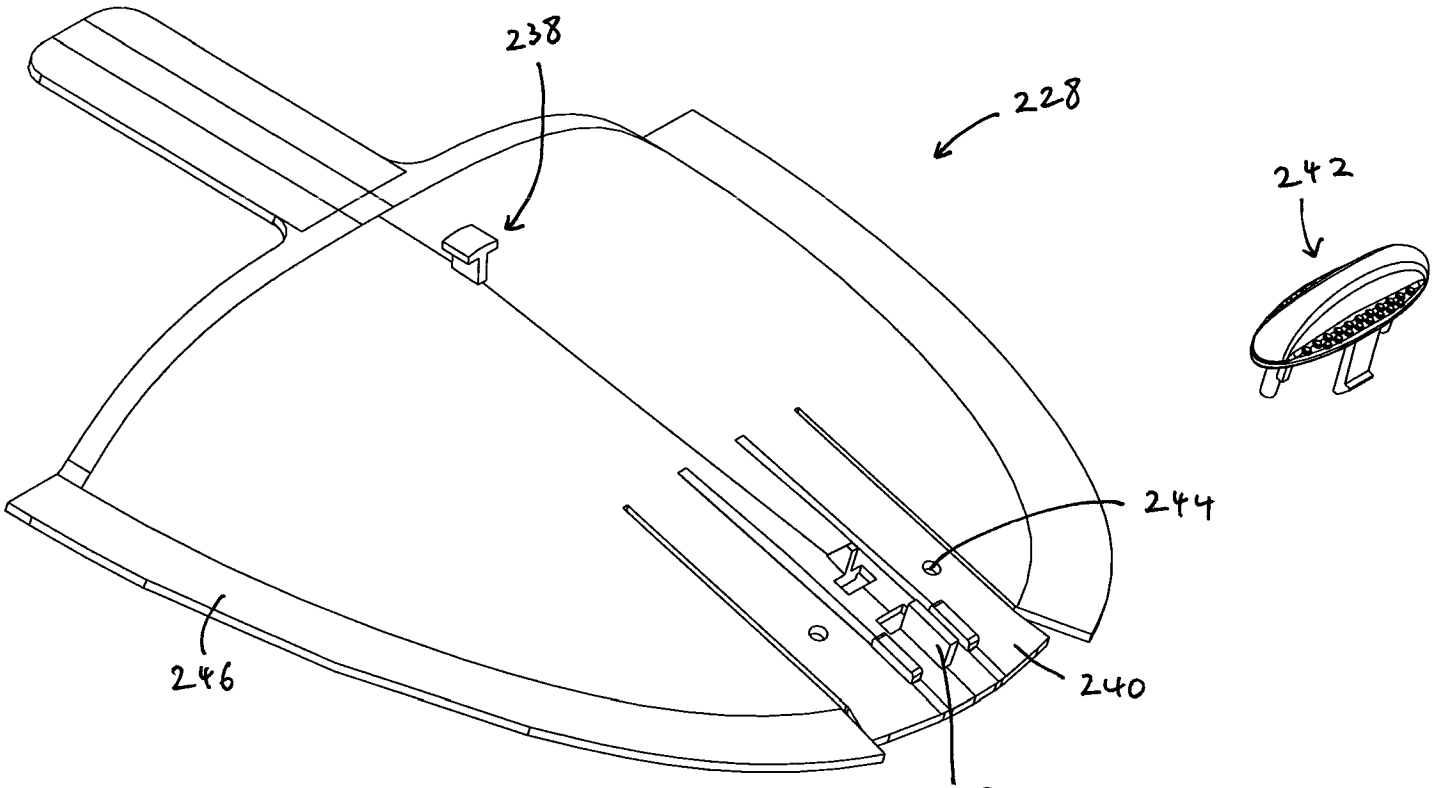
FIG. 15B is an exploded view of the door and a grasping element.

FIG. 15A and FIG. 15B show a grille 226 and a door 228 configured to define the downward vent 224. In FIG. 15B, the present embodiment of the door 228 is substantially shaped as one longitudinal half of an ellipse with a convex surface toward the exterior of the air distribution cover 103. The door 228 is configured to interact with the air distribution cover 103 to open and close the grille 226 which is substantially similar in shape to the door 228. The grille 226 can comprise part of a gutter 230 (see FIG. 15A) of the air distribution cover 103 along which the door 228 translates. The gutter 230 can include a slot 232 between two adjacent grille members. A T-shaped guide 238 of the door 228 can travel within the slot 232 thereby guiding the translating movement of the door 228 and determining the extent of the movement. The door 228 includes a biasing member 240 and a grasping element 242 which is a detachable part that engages the biasing member 240 from the other side of the grille 226. In this embodiment, the biasing member 240 is a cantilever beam and includes apertures 244 being engaged by the grasping element 242. Manipulation of the grasping element 242 moves the door 228 along the direction of the grille 226 as the door 228 is gradually opened. Because flange portions 246 of the door 228 keep the door 228 away from the grille 226, the biasing member 240 encourages the door 228 toward the grille 226. Biasing the door 228 toward the grille 226 results in sufficient friction such that the door 228 can maintain a position between a fully opened position and a fully closed position. The biasing member 240 includes a stop 248 which can abut against the air distribution cover 103 and define the fully closed position. The door 228 can conform to a curvature of the grille 226 in the fully closed position.

Figure 16A:
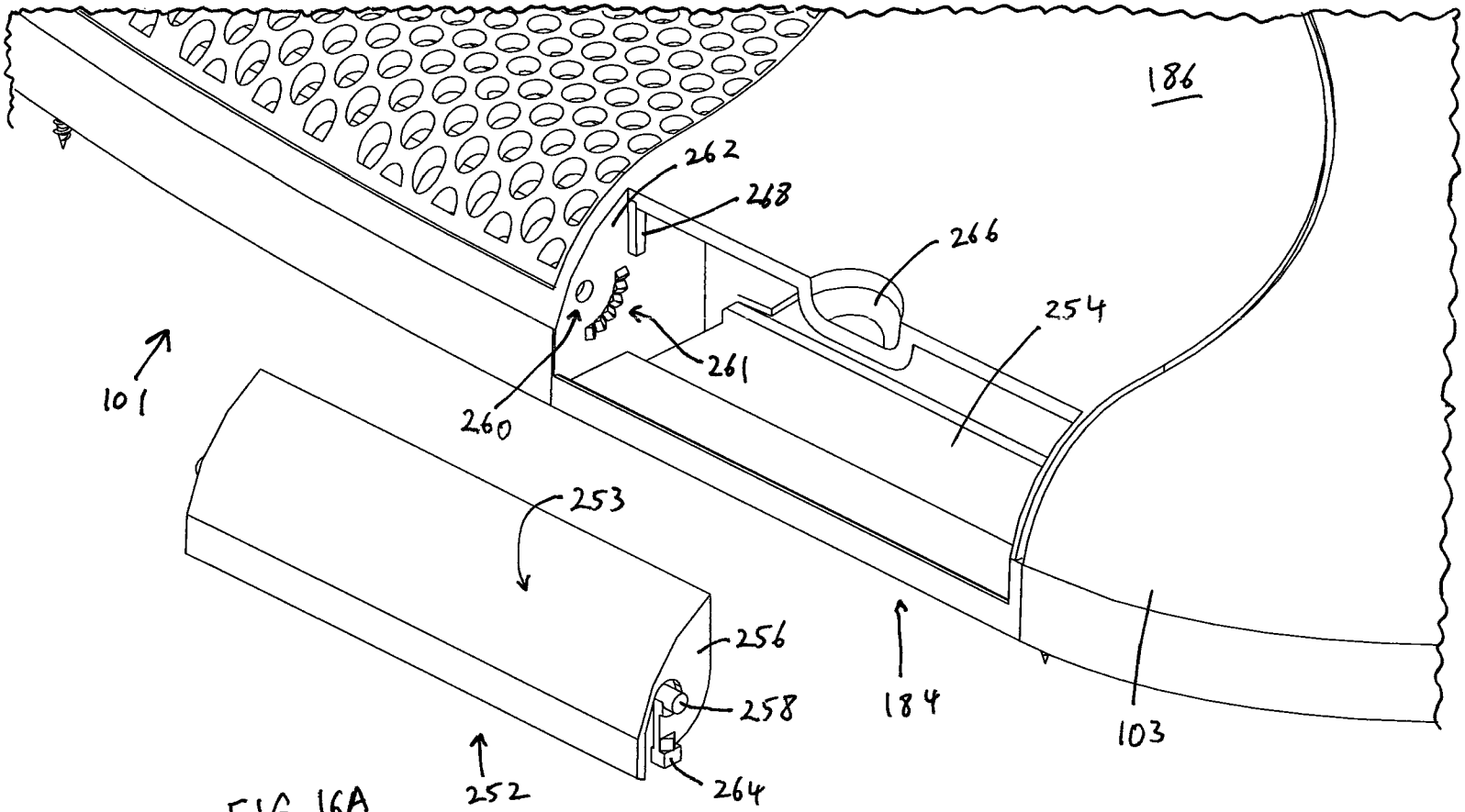
FIG. 16A is a exploded view of a pivoting cap and a side opening of a side air vent.
Figure 16B:
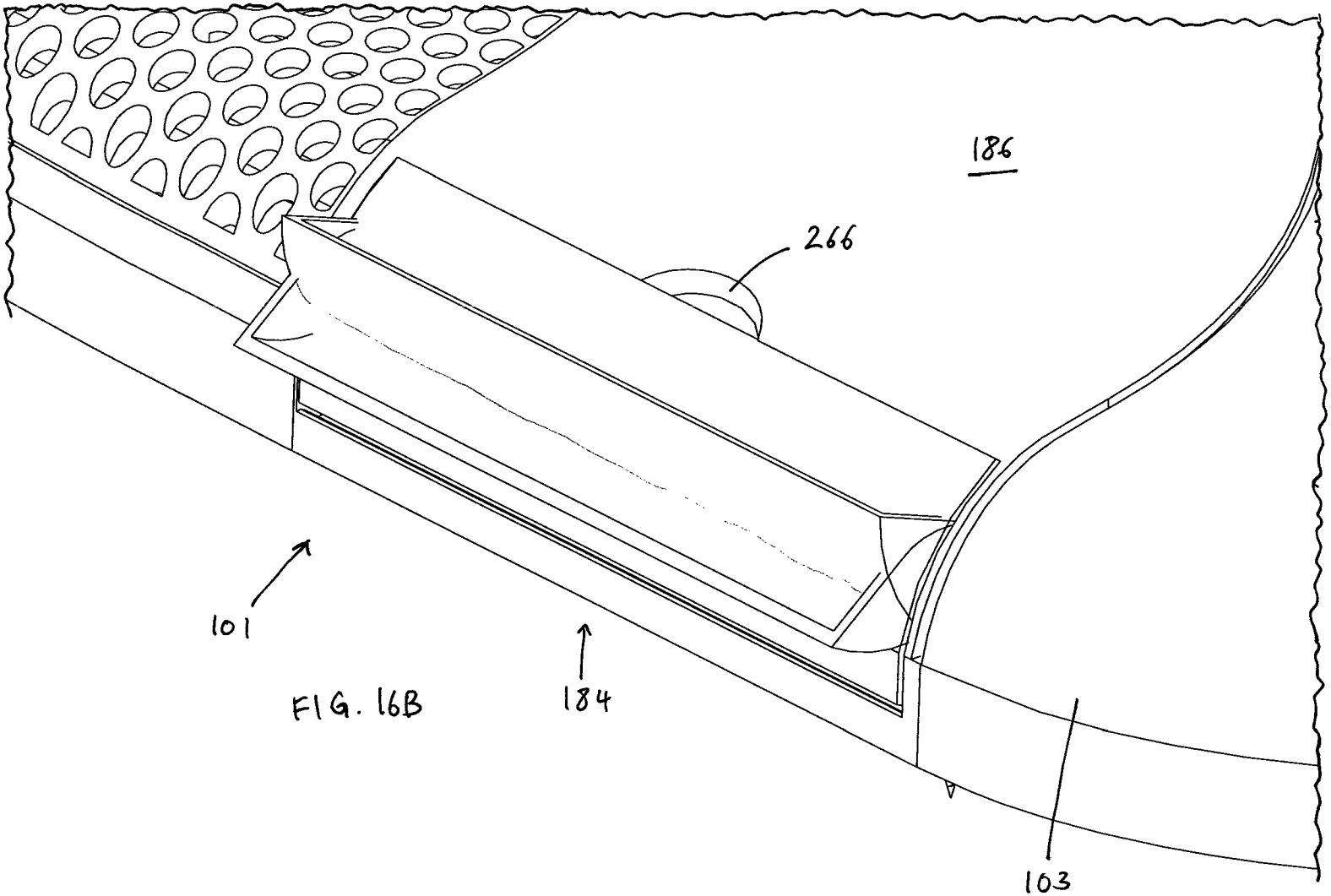
FIG. 16B is an assembled view of the side air vent showing multiple positions of the pivoting cap.

FIGS. 16A and 16B show an example side air vent 184. The other side air vent 180 can be a mirror image of the side air vent 184. Thus, it is understood that the structure and operation of both side air vents 180, 184 can be understood based on the following examples of the side air vent 184. As shown in FIGS. 16A and 16B, the side air vent 184 can include a pivoting cap 252 and a side opening 254 on the air distribution cover 103. The pivoting cap 252 can include a substantially curved surface 253 with a rectangular perimeter that conforms in shape to a curvature of the air distribution cover 103 in a fully closed position. The pivoting cap 252 may include bases 256 that can extend perpendicularly about the surface 253 and can include pivots 258 (one of two shown FIG. 16A) that snappingly mate with corresponding apertures 260 on walls 262 adjacent the side opening 254 thereby allowing the pivoting movement of the pivoting cap 252. The bases 256 can also include a latch 264 that engages the air distribution cover 103 at locations 261 defining discrete positions (see FIG. 16B) of the pivoting cap 252. The locations 261 can be formed by apertures, detents, openings, slots or the like. The air distribution cover 103 can also be provided with a sunken portion 266 to facilitate grasping of the pivoting cap 252. The pivoting cap 252 is opened through rotation away from the bottom wall 186 of the air distribution cover 103 and closed through rotation toward the bottom wall 186. The rotation of the pivoting cap 252 ranges from a fully closed position in which the pivoting movement is stopped by the sunken portion 266 and/or the edge of the side opening 254 and a fully opened position in which the pivoting movement is stopped by a shoulder 268 adjacent the side opening 254.

Figure 17A:
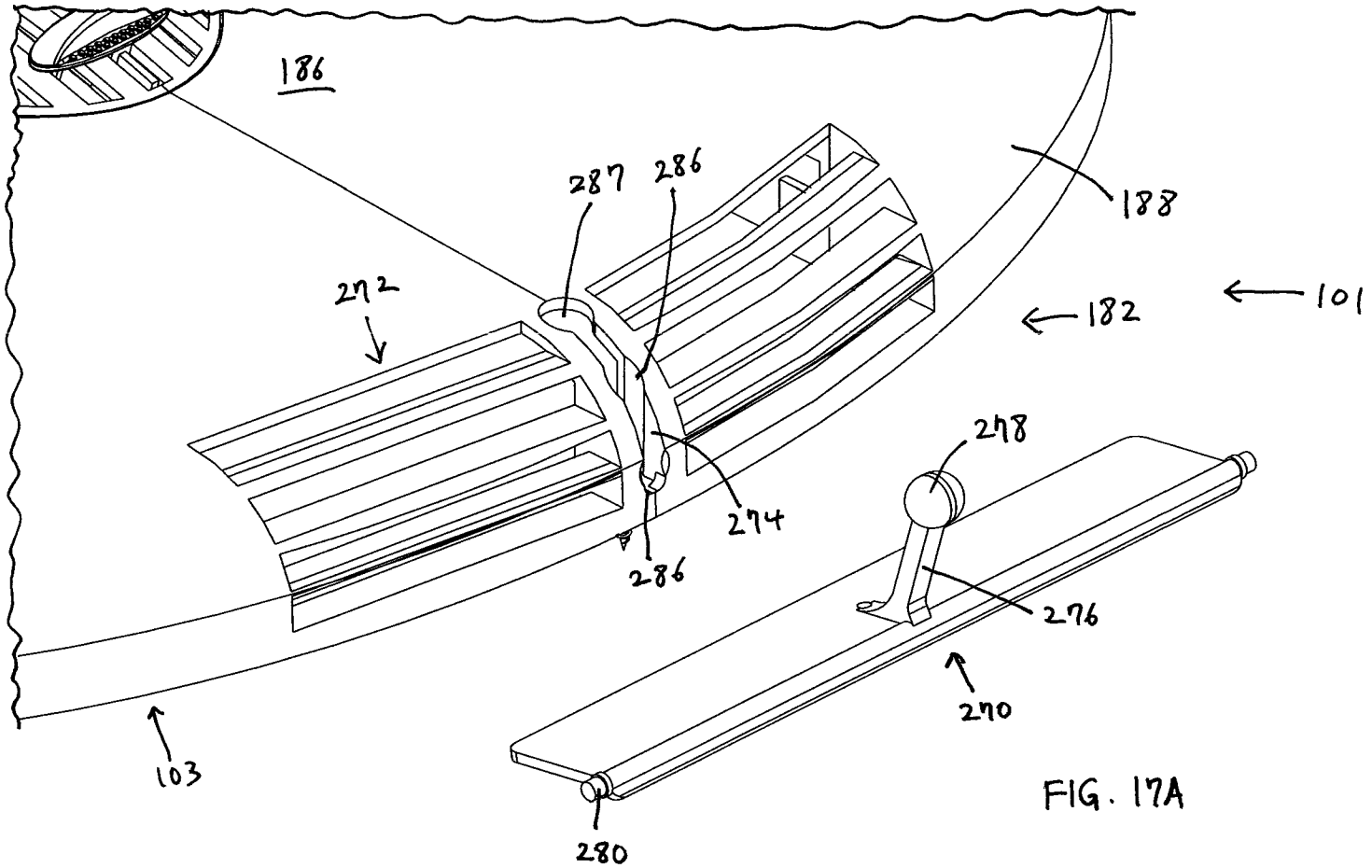
FIG. 17A is an exploded view of a pivoting door and a grille of an end air vent.
Figure 17B:
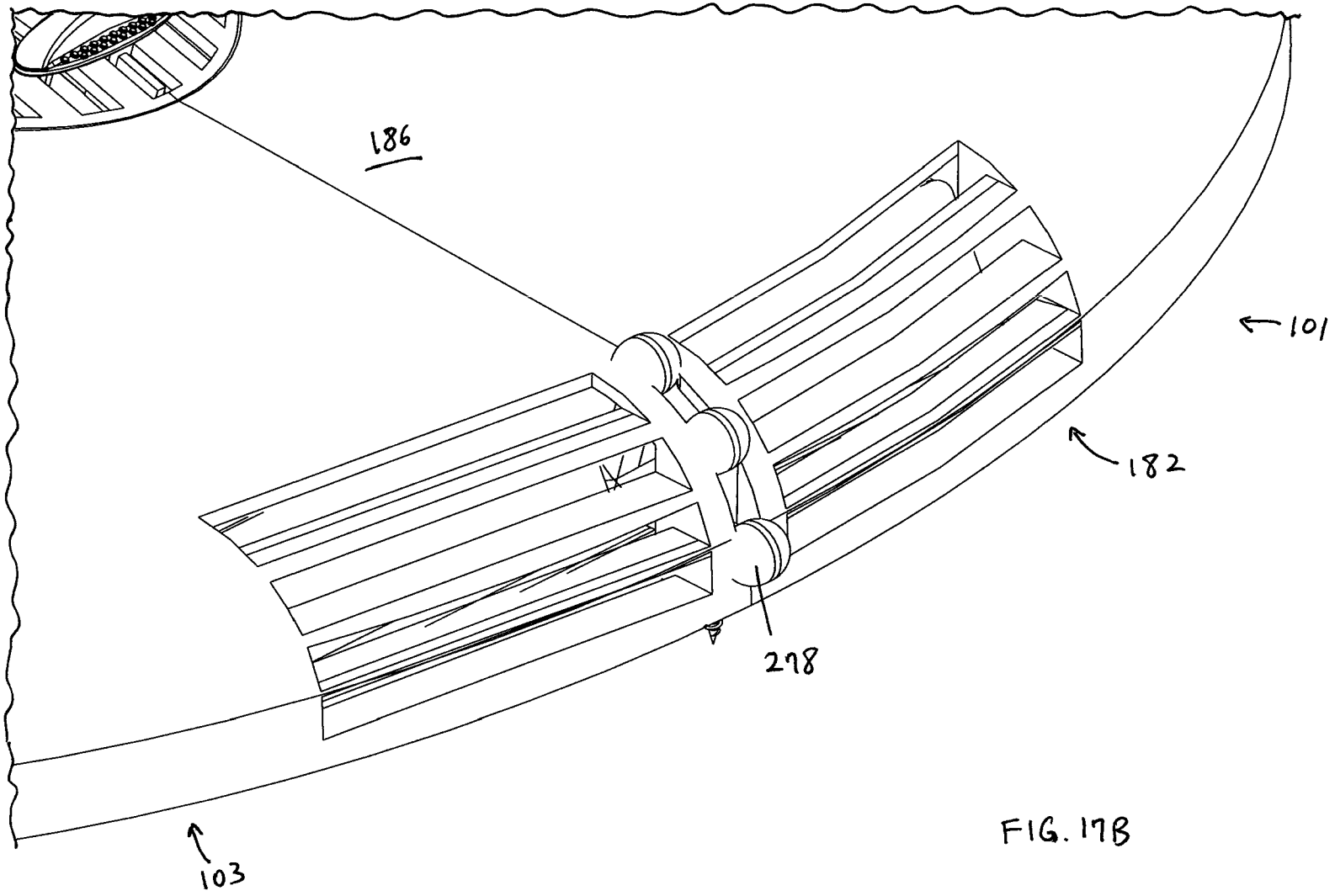
FIG. 17B is an assembled view of the end air vent showing multiple positions of the pivoting door.

As shown in FIGS. 17A and 17B, the end air vent 182 can include a pivoting door 270, a grille 272 and a slot 274. The other end air vent 178 can be a mirror image of the end air vent 182. Thus, it is understood that the structure and operation of both end air vents 178, 182 can be appreciated based on the following descriptions of the end air vent 182. The pivoting door 270 may include a link 276 and an enlarged end 278 where the link 276 extends from the pivoting door 270 to an enlarged end 278. The pivoting door 270 can also include pivots 280 extending along a rotation axis and configured to snappingly mate with apertures (not shown) on walls 183 (see FIG. 11A) adjacent the end air vents 178, 182 to allow the pivoting movement of the pivoting door 270. The link 276 is configured to rotate about the rotation axis of the pivoting door 270 and passes through the slot 274 in the assembled state. As shown in FIG. 17B, the slot 274 can include enlarged portions 286, 287 that define discrete positions of the pivoting door 270 formed by allowing the enlarged end 278 to achieve stable conditions. The discrete positions of the pivoting door 270 are further defined by the fact that the length of the link 276 is configured so that the enlarged end 278 elastically engages the slot 274 to encourage seating of the enlarged end 278 in the enlarged portion 286, 287 corresponding to the discrete positions. In the present embodiment of the end air vent 178, 182, a fully closed position of the pivoting door 270 is reached when the link 276 is fully rotated toward the bottom wall 186 while a fully opened position of the pivoting door 270 is reached when the link 276 is fully rotated away from the bottom wall 186.

This example embodiment of the air distribution apparatus 101 is assembled in the following manner as shown in FIG. 2. The upper end of the supply air duct 106 is secured to the air conditioner 107 via upper bracket with double stick tape or snaps. The electric box 154 is mounted on the air distribution template 102. The brackets 104, 105 are assembled onto the air distribution template 102. The brackets may be secured with respect to the air conditioning port and then the lower end of the supply air duct 106 can be fastened to the air distribution template 102 using the ring 150. Excess supply air duct 106 is removed. The air vent components are assembled on the air distribution cover 103, and the air distribution cover 103 is mounted onto the air distribution template 102. The air filters 212 can be inserted after the air distribution cover 103 is mounted on the air distribution template 102. The air distribution template 102 and the air distribution cover 103 have apertures 288 (see FIG. 11A) that are axially aligned after mounting the air distribution cover 103 onto the air distribution template 102 so that the two can be secured together using fasteners such as screws. The template barrier elements 170, 172, 174, 176 may include latches (not shown) near the end air vents 178, 182 that engage projections 185 on the walls 183 (see FIG. 11A) to secure the air distribution template 102 to the air distribution cover 103 without fasteners.

After assembly is completed, the air distribution apparatus 101 forms a device that is able to channel air to and from an air conditioner 107. In one example, the air distribution apparatus can channel air in one or more of four laterally orthogonal directions and a downward direction while creating only a slight protrusion in the ceiling. The air distribution apparatus 101 has a low profile because the air distribution template 102 is substantially submerged within the air distribution cover 103 while at the same time securing the bracket structure. In further examples, the low profile can be enhanced by allowing the body portion 110 of the brackets 104, 105 to at least partially extend into the air conditioning port 108 in the ceiling surface 111. In still further examples, as described above, the electric box 154 can be secured to the air distribution template 102 to contribute to the low profile of the air distribution apparatus 101. As shown in FIG. 3C, the air distribution template 102 allows the overall thickness $T_1$ of the air distribution apparatus 101 to be reduced to less than the sum of the thickness $T_2$ of the bracket structure and the thickness $T_3$ of the air distribution cover 103. The thickness $T_3$ of the air conditioning cover 103 represents the thickness adjacent the outer perimeter. In further examples the thickness $T_3$ can extend over a substantial portion of the cover. Certain portions of the cover 103 may be greater in thickness than $T_3$. For example, the portion of the cover 103 including the gutter 230 (see FIG. 15A) can extend further than the thickness $T_3$ of the remaining portions of the air conditioning cover 103. In one example, a low profile air distribution apparatus 103 can be provided with a thickness $T_3$ of less than about 2½ inches. In still further examples, the thickness $T_3$ can be from about ½ to about 2 inches. In yet further examples, the thickness $T_3$ can be from about 1 to about 2 inches. In yet further examples, the thickness $T_3$ can be from about 1½ to about 2 inches. In one example, the thickness $T_3$ can be about 1⅝ inches. Moreover, the gutter area, in examples, can extend further beyond the thickness $T_3$. For example, the gutter area may extend 2¾ inches with the thickness $T_3$, for example, being from about 1½ to about 2 inches, such as 1⅝ inches.

The electric box 154 can be partially recessed within the air distribution template 102 to contribute to the low profile of the air distribution apparatus 101. In further examples, the electrical box can extend at least partially in the air conditioning port to contribute to the low profile of the air distribution apparatus 101. It is also possible to have an air distribution template 102 without a second opening 152 for the electric box 154. I In one example, the air distribution apparatus 101 can be mounted with respect to the air conditioning port 108 in the ceiling surface 111. The air distribution cover 103 can include a sidewall and a bottom wall defining an interior cavity. The side wall defines a mounting edge extending about a periphery of the cover. The electric box 154 includes electrical components and can extend at least partially outside of the interior cavity of the cover.

In further examples, the electrical box 154 can be positioned partially inside the interior cavity and partially outside the interior cavity as shown in FIG. 3C. In further examples, the mounting edge can define the footprint of the air distribution apparatus. In yet further examples, the mounting edge extends along a common plane. For example, as shown in FIG. 3C, the mounting edge extends along a common plane of the ceiling surface 111. In further examples, the air distribution template 102 with the electrical box 154 can be attached to the air distribution template 102 and the air distribution cover 103 can be attached to the template 102. As shown in FIG. 3C, in still further examples, the electrical box 154 can extend at least partially through an opening in the template.

In another example, a method of installing an air distribution apparatus 101 with respect to the air conditioning port 108 in the ceiling surface 111 is provided. The method includes the steps of providing an air distribution cover 103 including an internal cavity and the electrical box 154 including electric components. The method further includes the step of mounting the electric box 154 with respect to the air distribution cover 103. The method still further includes the step of mounting the air distribution cover 103 and electric box 154 with respect to the ceiling surface 111 such that at least a portion of the electric box 154 extends within an the conditioning port 108 in the ceiling surface 111.

In one example, an air distribution apparatus for mounting with respect to an air conditioning port in a ceiling surface is provided. The air distribution apparatus includes at least one bracket and an air distribution device. The at least one bracket includes a body portion and a protrusion extending from the body portion. The protrusion includes an abutment surface configured to abut a ceiling surface while the body portion at least partially extends into an air conditioning port of a ceiling surface. The air distribution device is configured to be mounted to the bracket to distribute air from an air conditioning port in a ceiling surface.

In another example, the body portion of the bracket may include a truss structure configured to vertically reinforce the bracket. The body portion of the bracket may also include at least one vertical fastener opening configured to fasten the bracket with respect to an air conditioning port. In another example, the abutment surface may extend at an approximate 90° angle with respect to the body portion. In yet another example, the at least one bracket may comprise a first bracket and a second bracket. In one example, the first and second brackets may be substantially identical to one another.

In another example, an air distribution apparatus for mounting with respect to an air conditioning port in a ceiling surface is provided. The air distribution apparatus includes at least one bracket and an air distribution device. The air distribution device includes an air distribution template configured to be interlocked with the bracket and an air distribution cover configured to be attached to the air distribution template.

In one example, the air distribution template may include a mounting tab and the bracket may include a horizontally extending aperture configured to receive the mounting tab. In another example, an area of the bracket and an area of the air distribution template may be configured to be snapped together. In still another example, the at least one bracket comprises a first bracket and a second bracket. In one example, the first bracket and the second bracket may be substantially identical to one another. In another example, the air distribution template may include a mounting tab and the first bracket may include a horizontally extending aperture configured to receive the mounting tab. In yet another example, an area of the second bracket and an area of the air distribution template are configured to be snapped together. In still another example, the air distribution template may include a mounting tab and the body portion of the first bracket may include a horizontally extending aperture configured to receive the mounting tab. In another example, the bracket may include a body portion and a protrusion extending from the body portion, and the protrusion may include an abutment surface configured to abut a ceiling surface while the body portion at least partially extends to an air conditioning port of a ceiling surface.

In another example, an air distribution apparatus for mounting with respect to an air conditioning port in a ceiling surface is provided. The air distribution apparatus includes an air distribution device, a first bracket and a second bracket. The air distribution device includes a mounting tab. The first bracket includes a horizontally extending aperture configured to receive the mounting tab. An area of the second bracket and an area of the air distribution device are configured to be snapped together.

In still another example, a method of installing an air distribution apparatus is provided. The air distribution apparatus includes at least one bracket and an air distribution device. The at least one bracket includes a body portion and a protrusion extending from the body portion. The protrusion includes an abutment surface. The method includes the steps of attaching the air distribution device to the bracket, inserting the body portion of the bracket at least partially into an air conditioning port in a ceiling surface, and fastening the body portion of the bracket with respect to the air conditioning port by adjusting a fastener such that the abutment surface of the bracket abuts the ceiling surface.

In still another example of the invention, a method of installing an air distribution apparatus including at least one bracket and an air distribution device is provided. The air distribution device includes an air distribution template with a mounting tab and an air distribution cover. The at least one bracket includes a first bracket and a second bracket. The first bracket includes a body portion with a horizontally extending aperture. The method includes the steps of inserting the mounting tab of the air distribution template into the horizontally extending aperture of the first bracket, snapping an area of the second bracket to an area of the air distribution template, fastening the first bracket and the second bracket with respect to an air conditioning port, and attaching the air distribution cover to the template.

In still another example of the invention, a method of installing an air distribution apparatus including at least one bracket and an air distribution device is provided. The air distribution apparatus includes an air distribution template and an air distribution cover. The method includes the steps of interlocking the air distribution template with the bracket, fastening the bracket with respect to an air conditioning port, and attaching the air distribution cover to the template.

In still another example of the invention, a method of installing an air distribution apparatus including an air distribution device is provided. The air distribution device includes a mounting tab, a first bracket including a horizontally extending aperture, and a second bracket. The method includes the steps of inserting the mounting tab of the air distribution device into the horizontally extending aperture of the first bracket, snapping an area of the second bracket to an area of the air distribution device, and fastening the first bracket and the second bracket with respect to an air conditioning port.

In still another example of the invention, an air distribution apparatus for mounting with respect to an air conditioning port in a ceiling surface is provided. The air distribution apparatus includes an air distribution device and an air distribution template. The air distribution device includes an air distribution cover including a bottom wall and at least one cover barrier element attached to the bottom wall. The air distribution template includes a body portion and at least one template barrier element attached to the body portion of the template. The air distribution cover is configured to be mounted with respect to the air distribution template with the cover barrier element and the template barrier element defining at least one double-barrier structure dividing an supply air area from an return air area.

In one example, the cover barrier element and the template barrier element may be of substantially similar shape. In another example, the cover may include at least one side air port with the double-barrier structure at least partially defining a side supply air path in communication with the side air port. In another example, the at least one template barrier element may include a first and second template barrier element attached to the body portion of the template. The at least one cover barrier element may include a first and second cover barrier element attached to the bottom wall of the cover. The first double-barrier structure can be defined by the first cover barrier element and the first template barrier element, and a second double-barrier structure can be defined by the second cover barrier element and the second template barrier element. In another example, the cover may include a first side air port with the first double-barrier structure at least partially defining a first side supply air path in communication with the first side air port, and the cover may further include a second side air port with the second double-barrier structure at least partially defining a second side supply air path in communication with the second side air port. In yet another example, the cover may include a first end air port, and the first and second double-barrier structures may define a first end supply air path in communication with the first end air port. In still another example, the template may further include a third barrier element and a fourth barrier element. The cover can include a second air port, and the third barrier element and the fourth barrier element can define a second end supply air path to the second air port. In another example, the air distribution cover and the template may define a receiving slot for a slidingly replaceable air filter. In still another example, the air filter may be shaped to substantially conform to the curvature of the air distribution cover in an inserted state, and the air filter may be equipped with a grasping portion to facilitate handling. In another example, the template may include a first slot configured to at least partially accept an electric box between the air distribution cover and the template. In yet another example, a control knob may be mounted on the air distribution cover and may be in operative engagement with a shaft extending from the electric box. In still another example, the control knob may engage a hexagonal ball of the shaft, and the shaft and the control knob may be misaligned. In another example, the template may also include a second slot for a supply air duct.

In still another example, an air distribution cover includes a sidewall and a bottom wall. The bottom wall includes a supply port comprising a grille and a door. The door is configured to translate with respect to the grille between a fully opened position and a fully closed position. The door includes a biasing member and a grasping element, wherein the grasping element is biased against the grille to maintain a position between the fully opened position and the fully closed position.

In another example, the door may conform to a curvature of the grille in the fully closed position. In still another example, the air distribution cover may include a gutter along which the door can translate between the fully opened position and the fully closed position. In another example, the grille may include a slot between two adjacent grille members, and the door may include a guide configured to travel within the slot thereby guiding the translating movement of the door. In yet another example, the biasing member may include a cantilever beam.

In still another example of the invention, an air distribution cover in air communication with an air conditioning port in a ceiling surface is provided. The air distribution cover includes a side wall, a bottom wall and a side air vent opened and closed through a pivoting cap shaped to conform to a curvature between the side wall and the bottom wall of the air distribution cover in a fully closed position.

In another example, the pivoting cap may have multiple discrete positions ranging from a fully opened position to a fully closed position. In another example, each discrete position may be defined by a latch of the pivoting cap engaging one of multiple locations on the air distribution cover. In still another example, the air distribution cover may include a shoulder to limit movement of the pivoting cap. In yet another example, the pivoting cap may be opened through rotation away from the bottom wall and closed through rotation toward the bottom wall. In another example, the air distribution cover may be equipped with a sunken portion to facilitate grasping of the cap.

In still another example of the invention, an air distribution cover in air communication with an air conditioning port in a ceiling surface is provided. The air distribution cover includes an end air vent opened and closed through a pivoting door. The pivoting door includes a handle with an enlarged end and a link extending from the enlarged end to the pivoting door. The end air vent includes a grille and a slot. The link extends through the slot. The slot includes enlarged portions shaped to receive the enlarged end.

In another example, the enlarged end may elastically engage the slot. In still another example, the pivoting door may have multiple discrete positions ranging from a fully opened state to a fully closed state.

In still another example, an air distribution cover in air communication with an air conditioning port in a ceiling surface is provided. The air distribution cover includes an end air vent opened and closed through a pivoting door. The pivoting door includes a handle with an enlarged end and a link extending from the enlarged end to the pivoting door. The end air vent includes a grille and a slot. The link extends through the slot. The slot includes enlarged portions forming discrete door positions.

In another example, the enlarged end may elastically engage the slot. In another example, the pivoting door may have multiple discrete positions ranging from a fully opened state to a fully closed state.

In yet another example, an air distribution apparatus for mounting with respect to an air conditioning port in a ceiling surface is provided. The air distribution apparatus includes a cover with a sidewall and a bottom wall defining an interior cavity. The side wall defines a mounting edge extending about a periphery of the cover. The air distribution apparatus further includes an electric box including electrical components, the electric box extending at least partially outside of the interior cavity of the cover.

In further examples, the electrical box can be positioned partially inside the interior cavity and partially outside the interior cavity. In further examples, the mounting edge can define the footprint of the air distribution apparatus. In yet further examples, the mounting edge extends along a common plane. In further examples, a template with the electrical box can be attached to the template and the cover attached to the template. In still further examples, the electrical box can extend at least partially through an opening in the template.

In another example, a method of installing an air distribution apparatus with respect to an air conditioning port in a ceiling surface is provided. The method includes the steps of providing a cover including an internal cavity and an electric box including electric components. The method further includes the step of mounting the electric box with respect to the cover. The method still further includes the step of mounting the cover and electric box with respect to the ceiling surface such that at least a portion of the electric box extends within an air conditioning port in the ceiling surface.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An air distribution cover including a sidewall and a bottom wall, the bottom wall including a supply port, comprising:

a grille and a door disposed above said grille, wherein the door is configured to translate with respect to the grille between a fully opened position and a fully closed position, wherein the door includes a cantilevered biasing member formed as part of the door and a grasping element connected to said cantilevered biasing member of said door and said grasping element depending below the grille, wherein the grasping element is biased toward the grille to provide sufficient friction to maintain a position between the fully opened position and the fully closed position.

2. The air distribution cover of claim 1, wherein the door conforms to a curvature of the grille in the fully closed position.

3. The air distribution cover of claim 1, wherein the air distribution cover includes a gutter along which the door can translate between the fully opened position and the fully closed position.

4. The air distribution cover of claim 3, wherein the grille includes a slot between two adjacent grille members, and the door includes a guide configured to travel within the slot thereby guiding the translating movement of the door.

5. The air distribution cover of claim 1, the cantilevered biasing member including a cantilever beam.

6. An air distribution cover including a sidewall and a bottom wall, the bottom wall including a supply port, comprising:

a grille and a door disposed on a first side said grille, wherein the door is configured to move relative to the grille between a fully opened position and a fully closed position, wherein the door includes a cantilevered biasing member formed as part of the door and a grasping element engaging said cantilevered biasing member of said door and said grasping element located on a second side of the grille, wherein the grasping element is biased toward the grille to provide sufficient friction to maintain a position between the fully opened position and the fully closed position.

* * * * *